US008544993B2

(12) United States Patent
Kobayashi et al.

(10) Patent No.: US 8,544,993 B2
(45) Date of Patent: Oct. 1, 2013

(54) INK CARTRIDGE AND INK BAG UNIT

(75) Inventors: Haruo Kobayashi, Ichinomiya (JP); Naoki Mizuno, Nagoya (JP)

(73) Assignee: Brother Kogyo Kabushiki Kaisha, Nagoya-shi, Aichi-Ken (JP)

( * ) Notice: Subject to any disclaimer, the term of this patent is extended or adjusted under 35 U.S.C. 154(b) by 0 days.

(21) Appl. No.: 13/337,643

(22) Filed: Dec. 27, 2011

(65) Prior Publication Data

US 2012/0162326 A1 Jun. 28, 2012

(30) Foreign Application Priority Data

Dec. 28, 2010 (JP) ..... 2010-293353
Dec. 28, 2010 (JP) ..... 2010-293360
Dec. 28, 2010 (JP) ..... 2010-293364
Dec. 28, 2010 (JP) ..... 2010-293367

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS 3,430,824 A 3/1969 Conners et al.
4,695,824 A 9/1987 Tazaki
5,793,396 A 8/1998 Sasaki
6,554,402 B2 * 4/2003 Trafton et al. ..... 347/49
6,695,757 B2 2/2004 Edwards et al.
6,837,576 B2 1/2005 Whitlock et al.
6,851,799 B2 2/2005 Trafton et al.
6,908,182 B2 6/2005 Nakazawa et al.
7,018,029 B2 3/2006 Ishizawa et al.
7,144,104 B2 * 12/2006 Katayama ..... 347/86
7,152,965 B2 12/2006 Ishizawa et al.
7,192,127 B2 3/2007 Kudo et al.
7,229,163 B2 6/2007 Shimizu et al.
7,237,880 B2 * 7/2007 Miyazawa et al. ..... 347/86
7,469,992 B2 12/2008 Suzuki et al.

(Continued)

FOREIGN PATENT DOCUMENTS

JP 2006-240131 A 9/2006

OTHER PUBLICATIONS

Office Action dated Jan. 7, 2013 from related U.S. Appl. No. 13/337,693.

(Continued)

*Primary Examiner* — Matthew Luu
*Assistant Examiner* — Patrick King
(74) *Attorney, Agent, or Firm* — Scully, Scott, Murphy & Presser, P.C.

(57) ABSTRACT

An ink cartridge includes an ink bag that is configured to store ink inside, a spout that is provided on the ink bag and that includes a hollow portion leading from a first opening to a second opening, and a case that houses the ink bag and that includes an inclined surface portion and an penetration portion, the inclined surface portion being a surface portion disposed obliquely in relation to an axial direction of the spout, the penetration portion being provided in the inclined surface portion and being opposite the second opening, each of the two layers of the sheets extending substantially parallel to a virtual plane that includes an axial line of the spout and that forms a right angle with the inclined surface portion, and the leading end portion of the spout being positioned inside of the case than is an outer face of the inclined surface portion.

19 Claims, 23 Drawing Sheets

(56) References Cited

U.S. PATENT DOCUMENTS

| | | | | |
|---|---|---|---|---|
| 7,690,759 | B2 | 4/2010 | Yamada | |
| 7,722,174 | B2 * | 5/2010 | Kimura et al. | 347/86 |
| 7,753,505 | B2 | 7/2010 | Sugahara et al. | |
| 7,806,523 | B2 | 10/2010 | Seino et al. | |
| 7,926,925 | B2 | 4/2011 | Ikezaki | |
| 7,954,931 | B2 | 6/2011 | Shimizu et al. | |
| 7,954,933 | B2 | 6/2011 | Fung et al. | |
| 8,136,932 | B2 * | 3/2012 | Nozawa et al. | 347/86 |
| 8,210,669 | B2 | 7/2012 | Komaki | |
| 8,322,835 | B2 * | 12/2012 | Aoki et al. | 347/86 |
| 8,393,721 | B2 | 3/2013 | Katoh et al. | |
| 2001/0040613 | A1 | 11/2001 | Nakazawa et al. | |
| 2003/0035032 | A1 | 2/2003 | Trafton et al. | |
| 2003/0038867 | A1 | 2/2003 | Yamamoto et al. | |
| 2003/0156175 | A1 | 8/2003 | Blease et al. | |
| 2004/0218021 | A1 | 11/2004 | Ishizawa et al. | |
| 2005/0057625 | A1 * | 3/2005 | Ishizawa et al. | 347/86 |
| 2005/0179751 | A1 * | 8/2005 | Seino et al. | 347/86 |
| 2006/0197813 | A1 * | 9/2006 | Ikezaki | 347/86 |
| 2008/0070008 | A1 * | 3/2008 | Namba et al. | 428/195.1 |
| 2008/0151020 | A1 | 6/2008 | Kimura et al. | |
| 2008/0252702 | A1 | 10/2008 | Aoki et al. | |
| 2008/0284810 | A1 | 11/2008 | Shimizu et al. | |
| 2008/0303881 | A1 * | 12/2008 | Hibbard et al. | 347/86 |
| 2009/0027462 | A1 * | 1/2009 | Berg | 347/86 |
| 2009/0027463 | A1 * | 1/2009 | Berg | 347/86 |
| 2009/0284573 | A1 | 11/2009 | Kambe | |
| 2009/0289971 | A1 * | 11/2009 | Gilson et al. | 347/7 |
| 2009/0303299 | A1 * | 12/2009 | Gilson et al. | 347/86 |
| 2010/0295908 | A1 * | 11/2010 | Katoh et al. | 347/86 |
| 2011/0134197 | A1 * | 6/2011 | Ishizawa et al. | 347/86 |
| 2011/0187772 | A1 * | 8/2011 | Tomoguchi et al. | 347/7 |
| 2011/0199443 | A1 | 8/2011 | Osawa et al. | |
| 2011/0285797 | A1 * | 11/2011 | Ogura et al. | 347/86 |
| 2012/0056954 | A1 * | 3/2012 | Asauchi et al. | 347/86 |
| 2012/0081481 | A1 * | 4/2012 | Gilson et al. | 347/86 |
| 2012/0242762 | A1 * | 9/2012 | Gilson et al. | 347/86 |
| 2012/0249693 | A1 * | 10/2012 | Mizuno | 347/86 |
| 2012/0249694 | A1 * | 10/2012 | Mizuno et al. | 347/86 |
| 2012/0249695 | A1 * | 10/2012 | Mizuno | 347/86 |
| 2012/0249696 | A1 * | 10/2012 | Mizuno | 347/86 |
| 2012/0249697 | A1 * | 10/2012 | Mizuno | 347/86 |
| 2012/0249698 | A1 | 10/2012 | Ishizawa et al. | |
| 2012/0320132 | A1 * | 12/2012 | Kondo et al. | 347/86 |
| 2013/0027481 | A1 * | 1/2013 | Kato | 347/86 |

OTHER PUBLICATIONS

Related U.S. Appl. No. 13/337,664, to Mizuno et al., filed Dec. 27, 2011.

Related U.S. Appl. No. 13/337,679, to Mizuno et al., filed Dec. 27, 2011.

Related U.S. Appl. No. 13/337,693, to Mizuno et al., filed Dec. 27, 2011.

Office Action dated Dec. 6, 2012 from related U.S. Appl. No. 13/337,664.

Office Action dated Dec. 21, 2012 from related U.S. Appl. No. 13/337,679.

Notice of Allowance dated Jun. 24, 2013 received in U.S. Appl. No. 13/337,664.

* cited by examiner

INK CARTRIDGE AND INK BAG UNIT

CROSS-REFERENCE TO RELATED APPLICATION

This application claims priority to Japanese Patent Application Nos. 2010-293353, 2010-293360, 2010-293364, and 2010-293367, respectively filed Dec. 28, 2010, the content of which is hereby incorporated herein by reference.

BACKGROUND

The present disclosure relates to an ink cartridge that includes an ink bag that stores ink and a case that houses the ink bag, and to an ink bag unit that includes an ink bag.

Generally, an inkjet printer (hereinafter referred to as a printer) is configured such that an ink cartridge for supplying ink to a print head can be attached to and detached from the printer. An ink cartridge that includes an ink bag, a spout, and a case is known as a general ink cartridge. In this type of ink cartridge, the ink bag may have flexibility and may store ink therein. The spout may be provided to be connected to the ink bag, and may be used to draw out the ink. The case may have a rectangular parallelepiped shape and may house the ink bag.

SUMMARY

The ink bag of the above-described known ink cartridge may have flexibility. Therefore, when the remaining amount of ink becomes small during printing, inner surfaces of the ink bag may come into contact with each other and the ink may be divided. Specifically, part of the ink may not reach the spout and may remain in an ink storage pack.

Various embodiments of the broad principles derived herein provide an ink cartridge and an ink bag unit that are capable of collecting remaining ink near a spout, even in a case where the amount of the remaining ink is small.

Embodiments provide an ink cartridge that includes an ink bag that at least includes two layers of flexible sheets disposed to face each other, that is formed in a bag shape, and that is configured to store ink inside, and a spout that is provided on the ink bag and that includes a hollow portion that leads from a first opening to a second opening. The first opening is communicatively connected with the ink bag. The second opening is provided in a leading end portion of the spout and is open to an outside of the ink bag. The ink cartridge also includes a case that houses the ink bag and that includes an inclined surface portion and an penetration portion. The inclined surface portion is a surface portion that is disposed obliquely in relation to an axial direction of the spout. The penetration portion is provided in the inclined surface portion and is opposite the second opening. Each of the two layers of the sheets extends substantially parallel to a virtual plane that includes an axial line of the spout and that forms a right angle with the inclined surface portion. The leading end portion of the spout is positioned inside of the case than is an outer face of the inclined surface portion.

Embodiments also provide an ink bag unit that includes an ink bag that at least includes two layers of flexible sheets disposed to face each other, that is formed in a bag shape, and that is configured to store ink inside, and a spout that is provided on the ink bag and that includes a hollow portion that leads from a first opening to a second opening. The first opening is communicatively connected with the ink bag. The second opening is provided in a leading end portion of the spout and is open to an outside of the ink bag. The ink bag unit also includes a plate member that includes a first surface, a second surface, and two edges. The second surface is an reverse side of the first surface. The two edges forms an obtuse angle. An outer surface of one of the two layers of the sheets of the ink bag is affixed to the first surface. An axial line of the spout is substantially parallel to a first edge that is one of the two edges of the plate member. The second opening of the spout is positioned in a vicinity of a second edge that is the other of the two edges of the plate member. The leading end portion of the spout does not project toward an outside of the plate member from the second side.

Embodiments further provide an ink cartridge that includes an ink bag that at least includes two layers of flexible sheets disposed to face each other, that is formed in a bag shape, and that is configured to store ink inside, and a spout that includes a hollow portion that leads from a first opening to a second opening. The first opening is communicatively connected with the ink bag. The second opening is provided in a leading end portion of the spout and is open to an outside of the ink bag. The ink cartridge also includes a first surface portion that is opposite one of the two layers of the sheets, that extends in an axial line direction of the spout, and that has a first edge located on aside of the second opening in the axial line direction, the first edge extending from a position that is farther from the first opening than is the second opening to a position that is closer to the first opening than is the second opening in the axial line direction, and a second surface portion that is opposite the other of the two layers of the sheets, that is on an opposite side of the ink bag from the first surface portion, that extends in the axial line direction, and that has a second edge located on a side the second opening in the axial line direction. The second edge extends from a position that is farther from the first opening than is the second opening to a position that is closer to the first opening than is the second opening in the axial line direction. The ink cartridge further includes a third surface portion that has a surface area that is smaller than each surface area of the first surface portion and the second surface portion, that obliquely intersects the axial line direction along the first edge and the second edge, and that is farther in the axial line direction from the first opening than is the second opening. The leading end portion of the spout does not project toward an outside from the third surface portion.

BRIEF DESCRIPTION OF THE DRAWINGS

Embodiments will be described below in detail with reference to the accompanying drawings in which.

DETAILED DESCRIPTION

Figure 1:
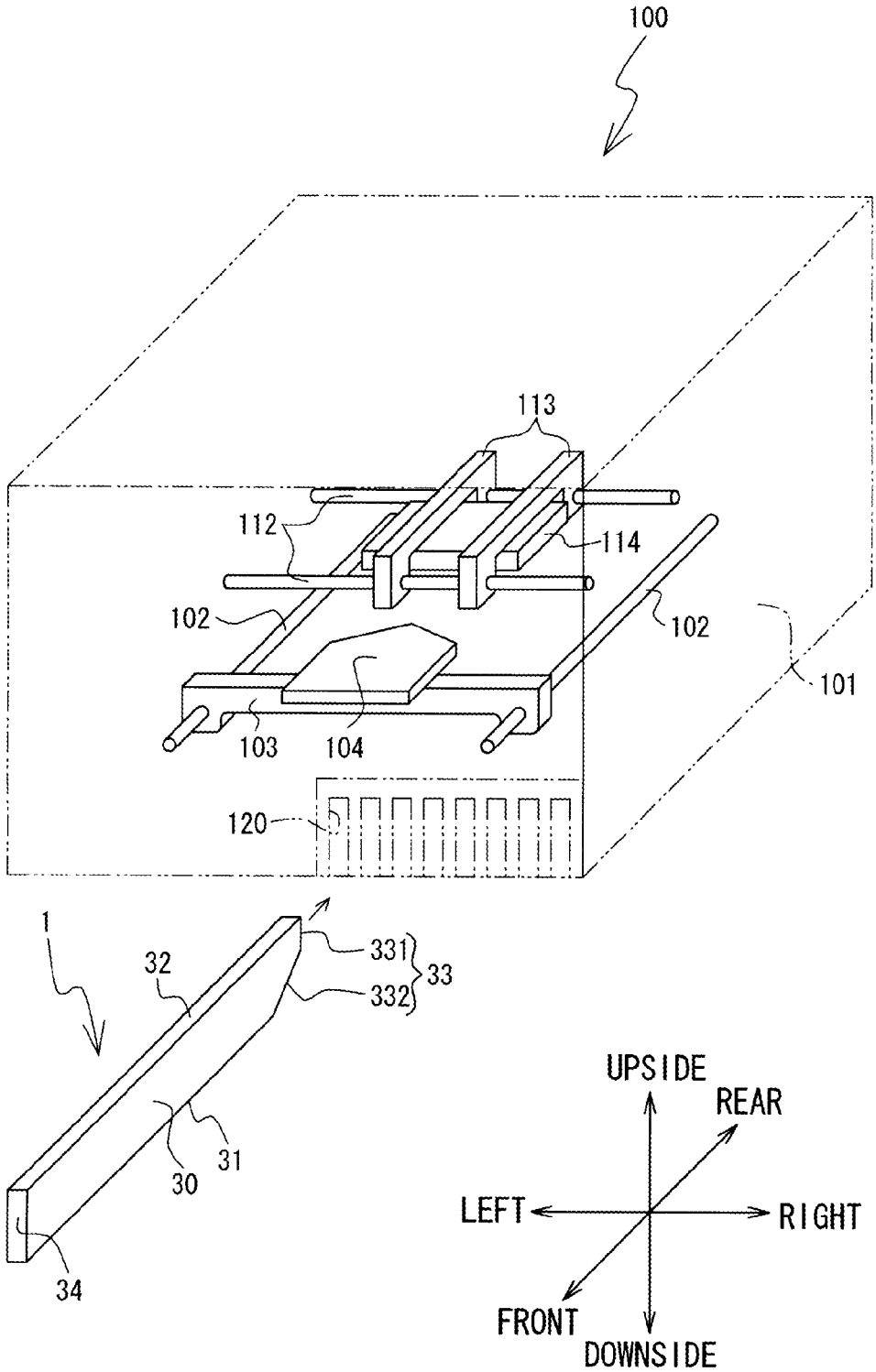
FIG. 1 is a schematic view showing a schematic configuration of an inkjet printer.

Hereinafter, an embodiment of the present disclosure will be explained with reference to the appended drawings,

First Embodiment

In the present embodiment, an ink cartridge 1 that is used for an inkjet printer 100 will be explained. The inkjet printer 100 may perform printing on a fabric such as a t-shirt. First, the inkjet printer 100 will be explained with reference to FIG. 1. The inkjet printer 100 is a known printer that can perform printing on a fabric, which is a printing medium, by a print head 114 using ink supplied from the ink cartridge 1. Therefore, the configuration of the inkjet printer 100 will be briefly explained. An up-down direction, a right-left direction and a lower left direction in FIG. 1 respectively correspond to an up-down direction, a right-left direction and a front side of the inkjet printer 100, and also an up-down direction, a right-left direction and a front side of the ink cartridge 1.

The inkjet printer 100 includes a housing 101 that has a rectangular box shape. A pair of guide rails 102 that extend in a front-rear direction are provided in a substantially central lower portion in the right-left direction inside the housing 101. A platen support 103 is supported by the guide rails 102 such that the platen support 103 can be moved in the front-rear direction along the guide rails 102. A platen 104 is fixed to a substantially center position in the right-left direction of an upper surface of the platen support 103. The platen 104 is replaceable. The platen 104 is a plate having a generally pentagonal shape in a plan view. A fabric, such as a t-shirt, may be placed on the upper surface of the platen 104. Although not shown in detail in the drawings, the platen support 103, to which the platen 104 is fixed, may be moved by a platen drive mechanism in the front-rear direction along the guide rails 102. The platen drive mechanism includes a platen drive motor and a belt transmission mechanism.

A pair of guide rails 112 that extend in the right-left direction are provided above the platen 104 in a substantially center position in the front-rear direction of the housing 101. A carriage 113 is supported by the guide rails 112 such that the carriage 113 can be moved in the right-left direction along the guide rails 112. The print head 114 is fixed to a lower portion of the carriage 113. Although not shown in detail in the drawings, the carriage 113 provided with the print head 114 may be moved by a carriage drive mechanism in the right-left direction along the guide rails 112. The carriage drive mechanism includes a carriage drive motor and a belt transmission mechanism. Ink may be supplied to the print head 114 via a tube 142 (refer to FIG. 6) from the ink cartridge 1 that is set in a cartridge mounting portion (not shown in the drawings). The cartridge mounting portion is provided inside the housing 101. A plurality of fine nozzles are provided on a bottom surface of the print head 114. Droplets of the ink may be discharged downward from the nozzles by driving of piezoelectric elements, and thus printing may be performed on the fabric placed on the platen 104.

Eight of the ink cartridges 1 can be set in the cartridge mounting portion provided inside the housing 101. Eight cartridge insertion ports 120 are provided in a lower right portion of a front surface of the housing 101. Each of the cartridge insertion ports 120 is an opening to insert and remove the ink cartridge 1 into and from an ink storage portion. The inkjet printer 100 of the present embodiment may use the four ink cartridges 1 for white ink, and the ink cartridges 1 that respectively store inks of four colors of cyan, magenta, yellow, and black. A method for supplying ink from the ink cartridge 1 to the inkjet printer 100 will be described below.

The structure of the ink cartridge 1 of the present embodiment will be explained with reference to FIGS. 1 to 5. As shown in FIGS. 1 to 4, the ink cartridge 1 includes a case 2 and an ink pack 7. The case 2 has a thin, substantially rectangular box shape that is long in the front-rear direction. The ink pack 7 is housed in the case 2. Hereinafter, the structures of the case 2 and the ink pack 7 will be explained in detail in order. The ink cartridges 1 for the five colors white, cyan, magenta, yellow, and black differ only in the colors of the liquid inks that are stored in the ink packs 7, and the structures of the case 2 and the ink pack 7 are the same for all the ink cartridges 1.

Figure 3:
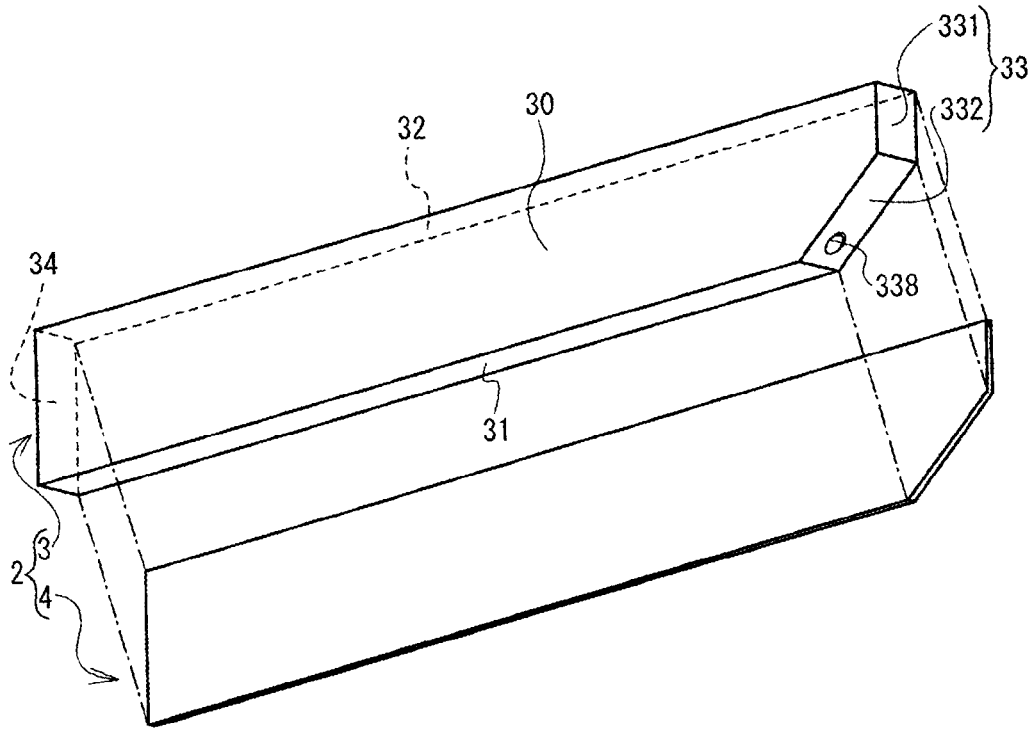
FIG. 3 is an exploded perspective view of a case.

As shown in FIG. 3, the case 2 includes a body portion 3 and a lid portion 4. The body portion 3 includes a right wall 30, a bottom wall 31, an upper wall 32, a rear wall 33, and a front wall 34 that each have a thin plate shape and respectively form a right side surface, a bottom surface, an upper surface, a rear surface and a front surface of the case 2. When the ink cartridge 1 is seen in a side view, namely, when the ink cartridge 1 is seen from a direction that is orthogonal to a maximum area portion (the largest surface among the surfaces shown in FIG. 3) of the right wall 30, the right wall 30 has a generally pentagonal shape. In a side view, the right wall 30 has such a shape that, among four corner portions that form right angles of a rectangle that is longer in the front-rear direction, a corner portion including a corner on the lower rear side is obliquely cut out. Specifically, in a side view, the right wall 30 has two long sides extending in the front-rear direction and facing in parallel to each other, two short sides extending in the up-down direction and facing in parallel to each other, and an oblique side that connects a shorter one of the two long sides and a shorter one of the two short sides.

The bottom wall 31, the upper wall 32, the rear wall 33 and the front wall 34 extend substantially perpendicular to the right wall 30 in the same direction and to the same length. The bottom wall 31 connects to a lower end portion of the right wall 30, namely, the shorter one of the pair of long sides. The upper wall 32 connects to an upper end portion of the right wall 30, namely, a longer one of the pair of long sides. The rear wall 33 includes the rear surface portion 331 and an inclined surface portion 332. The rear surface portion 331 connects to a rear end portion of the right wall 30, namely, the shorter one of the pair of short sides. The inclined surface portion 332 connects to the oblique side of the right wall 30. The inclined surface portion 332 connects the bottom wall 31 and the rear surface portion 331. The inclined surface portion 332 is provided with a penetration portion 338 in the vicinity of an end portion where the inclined surface portion 332 connects to the bottom wall 31. The penetration portion 338 is an opening that penetrates the inclined surface portion 332. The front wall 34 connects to a front end portion of the right wall 30, namely, a longer one of the short sides. The front wall 34 connects the bottom wall 31 and the upper wall 32.

A corner portion at which the upper wall 32 and the rear surface portion 331 are connected, a corner portion at which the upper wall 32 and the front wall 34 are connected, and a corner portion at which the bottom wall 31 and the front wall 34 are connected each form a right angle. On the other hand, a corner portion at which the inclined surface portion 332 and the bottom wall 31 are connected, and a corner portion at which the inclined surface portion 332 and the rear surface portion 331 are connected each form an obtuse angle. Hereinafter, the bottom wall 31, the upper wall 32, the rear wall 33, and the front wall 34 are referred to as the peripheral walls 31 to 34 when collectively referred to.

As shown in FIG. 3, the lid portion 4 faces the right wall 30 and forms a left side surface of the case 2. The lid portion 4 is a thin plate member and has a shape corresponding to the right wall 30 of the body portion 3. More specifically, when the ink cartridge 1 is seen in a side view, namely, when the ink cartridge 1 is seen from a direction that is orthogonal to a maximum area portion (the largest surface among the surfaces shown in FIG. 3) of the lid portion 4, the lid portion 4 has a generally pentagonal shape. In a side view, the lid portion 4 has such a shape that, among four corners forming right angles of a rectangle that is longer in the front-rear direction, a corner portion including a corner on the lower rear side is obliquely cut out. The lid portion 4 is joined to the body portion 3 to form the case 2. A method for joining the lid portion 4 to the body portion 3 is not particularly limited. Although not shown in the drawings, for example, the body portion 3 and the lid portion 4 may be provided with an engagement hole and an engagement pin, respectively. The lid portion 4 may be joined to the body portion 3 by inserting the engagement pin into the engagement hole. The lid portion 4 may be joined to the body portion 3 using an engagement hook and an engagement hole, instead of using the engagement pin. The body portion 3 and the lid portion 4 may be fixed by welding.

Figure 4:
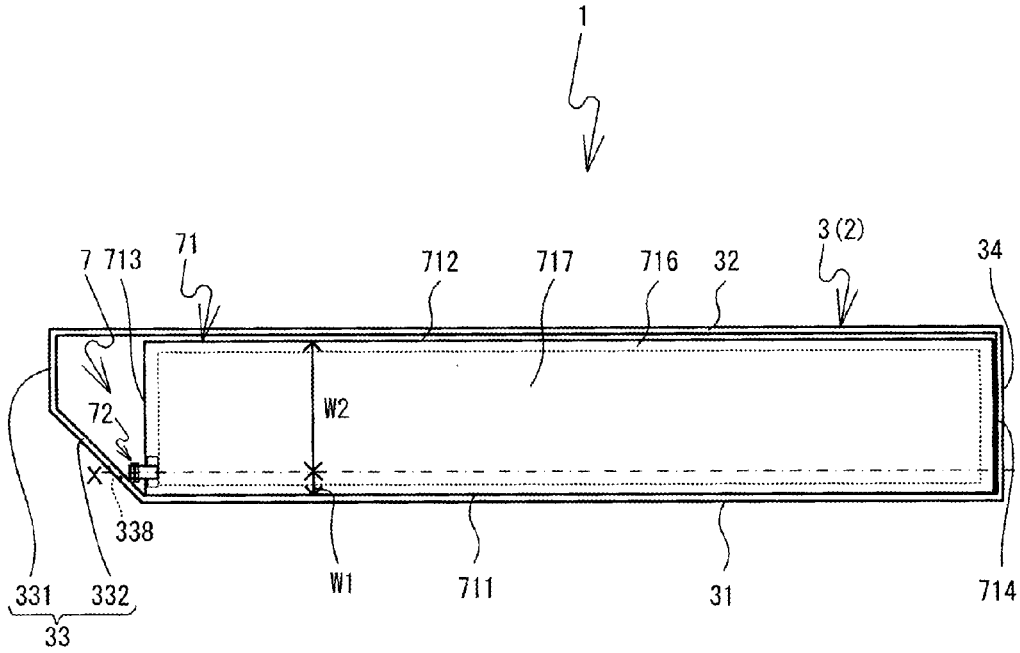
FIG. 4 is an explanatory view showing the ink cartridge in a state in which a lid portion is removed, as viewed from a left side surface.

As shown in FIG. 4, the ink pack 7 is housed inside the case 2, in a space that is surrounded by the peripheral walls 31 to 34. The ink pack 7 includes an ink bag 71 and a spout 72, which is provided on the ink bag 71. The ink bag 71 of the present embodiment is a bag-shaped container that is formed in the following manner. Two rectangular-shaped resin sheets are overlapped with each other such that inner surfaces of the sheets face each other, and a surrounding portion 716 along four sides is thermally welded (heat sealed). The resin sheets have flexibility. Ink may be stored inside an ink storage portion 717 that is a space surrounded by the surrounding portion 716. The ink storage portion 717 has a generally rectangular shape when seen from a direction that is substantially orthogonal to a sheet surface, namely, a maximum area portion (the largest surface among the surfaces shown in FIG. 4) of the sheet surface. The ink storage portion 717 may extend along inner surfaces of the case 2.

It is sufficient if the ink bag 71 includes two layers of flexible sheets that are disposed to face each other and the ink bag 71 is a bag-shaped container in which a space is formed that can store ink between the sheets. Therefore, for example, the ink bag 71 may be formed such that one rectangular sheet is folded in half to form two layers, and the two layers are joined along three sides other than a folded portion. Two sheets that face each other may be joined along three sides of the two sheets and the remaining one side of each of the two sheets may be joined to another sheet, thus forming the ink bag 71 having a bottom portion. The ink bag 71 may be formed such that four sides of two sheets that face each other are respectively joined to other sheets serving as gussets. A method for joining the sheets is not limited to welding and another method such as adhesive bonding, for example, may be used.

Figure 5:
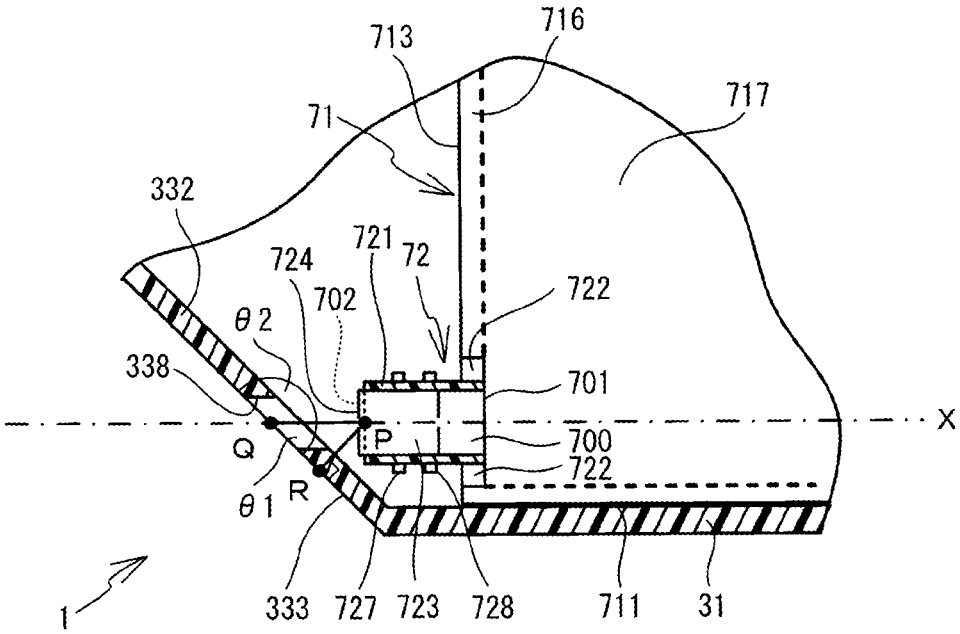
FIG. 5 is an enlarged vertical cross-sectional view of a spout surrounding portion of the ink cartridge.

As shown in FIGS. 4 and 5, the spout 72 includes a cylindrical-shaped body portion 721 and connection portions 722. The connection portions 722 are two blade-shaped members that protrude in directions opposite to each other from an outer peripheral surface of the body portion 721, and are provided on one end side of the body portion 721. The spout 72 is provided on the ink bag 71 such that an axial line X of the body portion 721 (more precisely, a hollow portion 700 that will be described below) is substantially in parallel with a longitudinal direction of the ink bag 71. The axial line X is located closer to one end portion of the ink bag 71 in a direction a shorter direction of the ink bag 71) that is orthogonal to the axial line X. In the present embodiment, the spout 72 is provided in the vicinity of one of four corner portions of the ink bag 71. Hereinafter, of two end portions of the ink bag 71 that are located in the direction orthogonal to the axial line X direction, the end portion that is closer to the axial line X is referred to as a first end portion 711 and the end portion that is farther from the axial line X is referred to as a second end portion 712. Of two end portions of the ink bag 71 that are located in the axial line X direction (the longitudinal direction of the ink bag 71), the end portion that is provided with the spout 72 is referred to as a third end portion 713 and the other end portion is referred to as a fourth end portion 714.

In the present embodiment, the spout 72 is fixed to the ink bag 71 such that one end portion of the body portion 721 that includes the connection portions 722 is inserted between the two sheets that form the ink bag 71, and the one end portion is welded integrally with the surrounding portion 716. The other end portion of the body portion 721 that is not welded with the surrounding portion 716 protrudes from the third end portion 713 of the ink bag 71 to the outside of the ink bag 71.

As shown in FIG. 5, the body portion 721 includes two flanges 727 and 728 that are provided along the outer periphery of the body portion 721. Further, the body portion 721 includes the hollow portion 700 inside the body portion 721. The hollow portion 700 leads from a first opening 701 to a second opening 702. The first opening 701 is communicatively connected to the ink storage portion 717 of the ink bag 71. The second opening 702 opens to the outside of the ink bag 71. A cylindrical rubber plug 723 is inserted into an end portion on the second opening 702 side of the hollow portion 700. Therefore, the second opening 702 is closed by the rubber plug 723. In this manner, the ink may be stored in the ink storage portion 717 in a sealed state. It is sufficient if the spout 72 is provided on the ink bag 71 such that the ink storage portion 717 communicates with the outside through the hollow portion 700, and a method for fixing the spout 72 is not limited to welding. Therefore, for example, the spout 72 may be formed integrally with the ink bag 71.

An arrangement relationship between the case 2 and the ink pack 7 will be explained in detail with reference to FIGS. 4 and 5. As shown in FIG. 4, the ink pack 7 is housed in the case 2 such that the axial line X of the spout 72 substantially match the longitudinal direction of the case 2. The ink pack 7 is housed in the case 2 such that the two layers of sheets that form the ink bag 71 extend substantially in parallel with a virtual plane that includes the axial line X of the spout 72 and forms a right angle with an outer surface 333 (refer to FIG. 5) of the inclined surface portion 332. Therefore, in the present embodiment, outer surfaces of the two layers of sheets extend respectively facing inner surfaces of the right wall 30 and the lid portion 4. The outer surface of one of the two layers of sheets that form the ink storage portion 717 may be adhered to the inner surface of one of the right wall 30 and the lid portion 4.

The sheets that form the ink bag 71 have flexibility. Therefore, when the amount of the remaining ink stored in the ink storage portion 717 is large, the two layers of sheets may curve in directions in which the two layers of sheets are separated from each other. When the remaining amount of the ink is small, the distance between the two layers of sheets may reduce and the two layers of sheets may deflect in directions in which the two layers of sheets come into contact with each other. In summary, because the sheets are not fixed flat surfaces, the sheets are not exactly in parallel with the above-described virtual plane. Therefore, the phrase "substantially in parallel" used in the relationship with the above-described virtual plane includes not only an accurate parallel relationship between flat surfaces, but also an almost parallel state in which deflection of the sheets is allowed.

Further, for example, when the body portion 3 of the case 2, namely, the right wall 30 and the peripheral walls 31 to 34 are integrally formed of resin, generally, a draft angle is provided in order to facilitate release from a cavity of a die. In this case, the right wall 30 and each of the peripheral walls 31 to 34 form an obtuse angle that is wider than a right angle by 2 to 4 degrees. Therefore, as described above, when the outer surface of the sheet of the ink bag 71 is adhered to the inner surface of the right wall 30, the above-described virtual plane and the sheet are not exactly in parallel with each other. However, in a similar manner to the above-described deflection allowance, even when there is an angle difference corresponding to the draft angle, it can be assumed that the above-described virtual plane and the sheet are "substantially in parallel" with each other.

The spout 72 is provided in relation to the case 2 such that the axial line X is positioned close to one end portion of the case 2 in the direction that is orthogonal to the axial line X. Hereinafter, of the end portions of the case 2 in the direction that is orthogonal to the axial line X, the end portion on the side toward which the spout 72 is disposed is referred to as the spout side end portion. In the present embodiment, as described above, the axial line X is aligned approximately in the longitudinal direction of the case 2. The axial line X is substantially parallel to the bottom wall 31 and the upper wall 32 of the case 2. Accordingly, the end portions of the case 2 that are in the direction that is orthogonal to the axial line X are the end portion on the bottom wall 31 side and the end portion on the upper wall 32 side. In the present embodiment, of the two end portions, the spout 72 is disposed closer to the end portion on the bottom wall 31 side, as shown in FIG. 4. Therefore, the end portion on the bottom wall 31 side is the spout side end portion.

Furthermore, the inclined surface portion 332 (more specifically, the outer surface 333) of the case 2 is disposed obliquely in relation to the axial line X of the spout 72. As shown in FIG. 5, an angle θ1 that is formed on the inner side of the case 2 by the axial line X and the outer surface 333 that slants toward the spout side end portion is an acute angle that is less than 90 degrees. An angle θ2 that is formed on the inner side of the case 2 by the axial line X and the outer surface 333 that slants in the opposite direction from the spout side end portion is an obtuse angle that is greater than 90 degrees. To be specific, a point on the axial line X (for example, a point of intersection between the axial line X and the opening plane of the second opening 702) is defined as a point P. The point of intersection between the axial line X and the outer surface 333 of the inclined surface portion 332 is defined as a point Q. The point at which a line that extends from the point P and that is perpendicular to the outer surface 333 intersects the outer surface 333 that is closer to the spout side end portion than the point Q is defined as a point R. An angle PQR is equivalent to the angle θ1. As shown in FIG. 4, taking the axial line X as a boundary, a width W1 (a distance between the axial line X and the first end portion 711) of the ink bag 71 on the spout side end portion side (the bottom wall 31 side) in the case 2 is narrower than a width W2 (a distance between the axial line X and the second end portion 712) of the ink bag 71 on the opposite side (the upper wall 32 side).

Furthermore, as shown in FIG. 5, the penetration portion 338 is provided in the inclined surface portion 332, at a position where the penetration portion 338 is opposite the second opening 702 of the spout 72. In other words, the penetration portion 338 is positioned on the axial line X of the spout 72. Accordingly, because the penetration portion 338 is provided, the intersection point Q between the axial line X and the outer surface 333 of the inclined surface portion 332 does not actually exist. Therefore, in the above-described relationships of the angles between the axial line X and the outer surface 333, the intersection point Q may be specified on the assumption that the penetration portion 338 is not provided. As described above, the second opening 702 is closed by the rubber plug 723. Therefore, the penetration portion 338 actually faces the rubber plug 723.

As shown in FIG. 5, the leading end portion of the rubber plug 723, that is, a leading end portion 724 on the second opening 702 side of the spout 72, is positioned toward the inner side of the case 2 from the outer surface 333 of the inclined surface portion 332. The leading end portion 724 is positioned such that a clearance is provided in the axial line X direction in relation to the inner surface (the right surface in FIG. 5) of the inclined surface portion 332. Therefore, the ink can move between the inclined surface portion 332 and the leading end portion 724 (below the leading end portion 724 in FIG. 5). In the present embodiment, the leading end portion 724 is positioned to the inside from the inner surface of the inclined surface portion 332. However, the leading end portion 724 may be positioned toward the inner side of the case 2 from the outer surface 333.

A method for supplying ink from the ink cartridge 1 to the print head 114 of the inkjet printer 100 will be explained with reference to FIGS. 1 and 6. As shown in FIG. 1, when printing is performed, a user may insert the ink cartridge 1 into the cartridge insertion port 120 of the inkjet printer 100. At this time, the user may insert the ink cartridge 1 from the rear wall 33 side, with the bottom wall 31 of the ink cartridge 1 being on the lower side. The rear wall 33 is provided with the penetration portion 338 (refer to FIG. 2) that faces the second opening 702 (the rubber plug 723).

Figure 6:
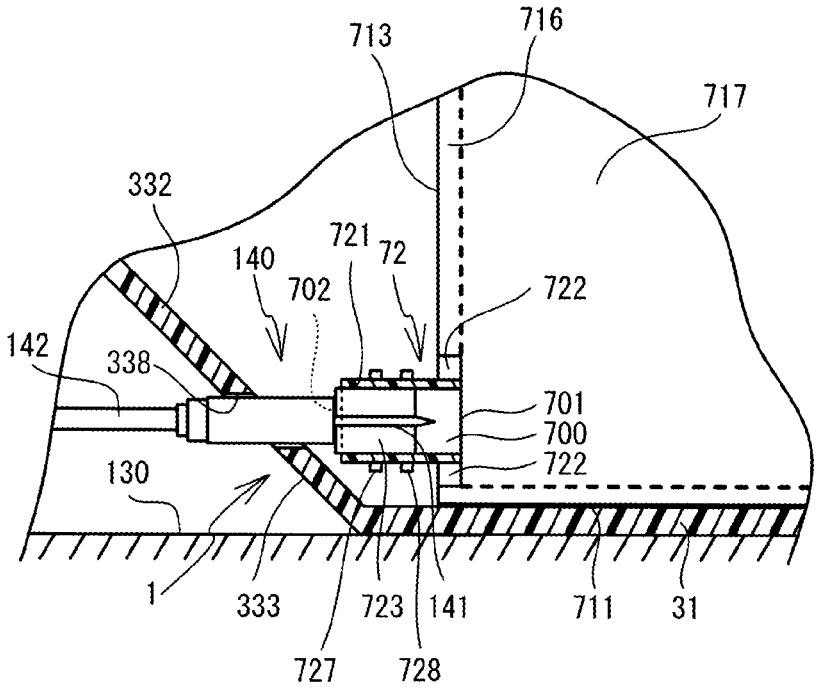
FIG. 6 is an enlarged partial cross-sectional view of the spout surrounding portion of the ink cartridge when ink is supplied.

As shown in FIG. 6, the ink cartridge 1 may be set such that the bottom wall 31 is placed on a placement surface 130 of the cartridge mounting portion. The placement surface 130 is a Out surface that extends in a substantially horizontal direction. Therefore, the ink cartridge 1 may be set in the inkjet printer 100 such that the bottom wall 31 and the axial line X of the spout 72 extend substantially horizontally. A connection portion 140 including a hollow needle 141 is provided inside the cartridge mounting portion, at a position facing the penetration portion 338 when the ink cartridge 1 is set. A tube 142 is connected to the connection portion 140. The tube 142 may lead the ink drawn out from the ink bag 71 to the print head 114. When the ink cartridge 1 is set in the cartridge mounting portion, the hollow needle 141 of the connection portion 140 pierces a central portion of the rubber plug 723 through the penetration portion 338. The hollow needle 141 may penetrate the rubber plug 723 and a leading end portion of the hollow needle 141 may be disposed inside the hollow portion 700. The leading end portion of the hollow needle 141 is provided with a hole through which ink flows. The ink in the ink storage portion 717 may be supplied to the print head 114 via the first opening 701, the inside of the hollow portion 700, the hollow needle 141, and the tube 142.

When the ink cartridge 1 is initially used, the ink storage portion 717 of the ink bag 71 may be completely filled with ink. Accordingly, the inner surfaces of the two layers of sheets that form the ink bag 71 may be separated from each other, with the ink interposed between the inner surfaces. While printing is performed, the ink may be discharged from the print head 114 little by little in order to form an image on the fabric. When the ink is discharged, a substantially same amount of ink as a discharge amount may be sucked from the ink cartridge 1, and the sucked ink may be supplied to the print head 114. The ink stored in the ink storage portion 717 may gradually reduce as the ink is consumed by printing, and the ink bag 71 may contract. As a result, the inner surfaces of the two layers of flexible sheets may come closer to each other.

When the amount of the remaining ink reduces to a certain extent, the inner surfaces of the sheets may come into contact with each other in various locations in the ink bag 71. As a result, the ink may be divided by portions where the inner surfaces of the sheets come into contact with each other, due to surface tension of the ink, gravitational force, and the like, for example. In this case, a plurality of ink deposits may exist that are isolated in the ink storage portion 717. Further, in a state in which the bottom wall 31 is placed on the substantially horizontal placement surface 130, the two layers of sheets of the ink bag 71 are disposed such that the surfaces of the sheets extend substantially in the up-down direction. Therefore, due to the gravitational force, part of the ink may flow downward along the inner surface of the sheet and may be accumulated along the first end portion 711 (refer to FIG. 4) inside the ink storage portion 717. As the ink reduces, the ink surface may become lower than the hole in the leading end portion of the hollow needle 141. In this case, even when the ink still remains in the ink storage portion 717, it is difficult to suck the remaining ink because a suction force of the print head 114 is weak.

Figure 7:
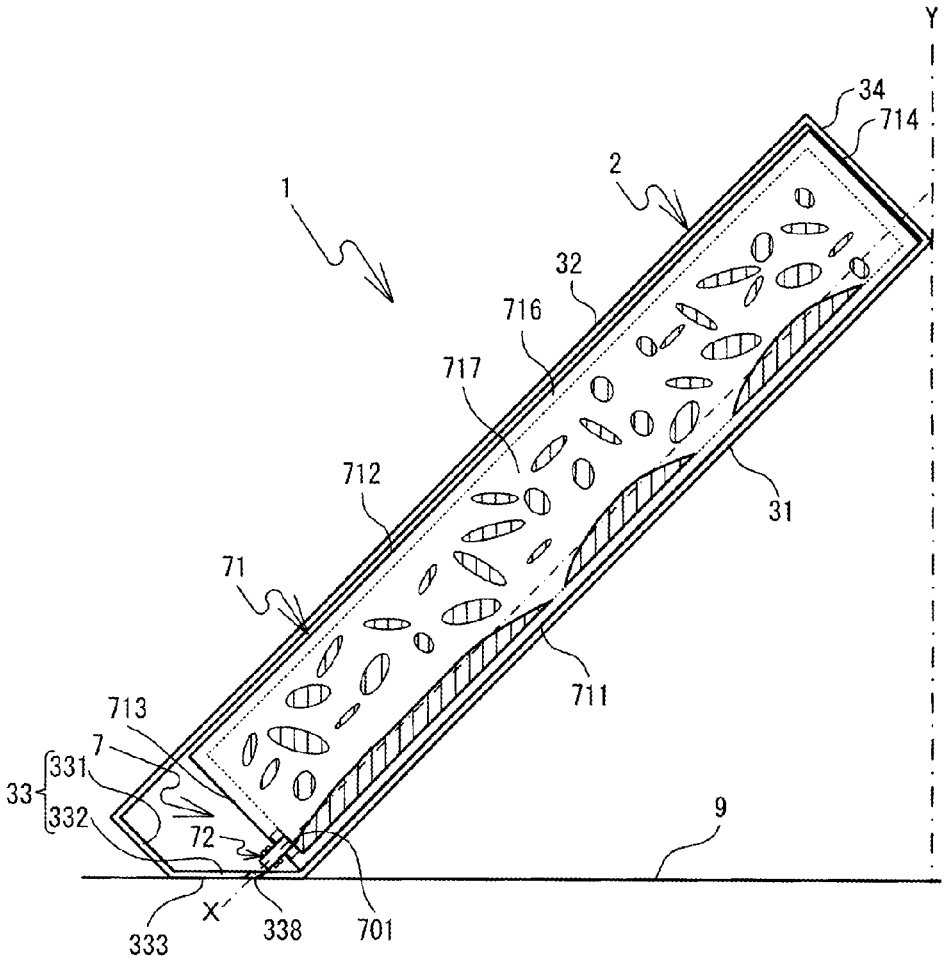
FIG. 7 is an explanatory view showing a process in which the ink is collected by tilting the ink cartridge.

Even in a case where it has become difficult for the ink to be sucked in this manner, the ink cartridge 1 of the present embodiment can be removed from the inkjet printer 100, and owing to the above-described structure, the ink remaining in the ink storage portion 717 can be efficiently collected toward the spout 72, more specifically, toward the first opening 701. This operational effect will be explained with reference to FIGS. 7 to 9. As shown in FIG. 7, the user may place the ink cartridge 1, in which the amount of the remaining ink has been reduced and the ink has accumulated to a certain extent along the first end portion 711, on a support surface 9 that is a substantially horizontal surface, with the inclined surface portion 332 being on the lower side. At this time, the user may place the ink cartridge 1 such that the outer surface 333 of the inclined surface portion 332 is supported by the support surface 9. Accordingly, the axial line X direction, which is substantially congruent with the longitudinal direction of the ink storage portion 717, may become closer to vertical than when the ink is supplied in the inkjet printer 100. The support surface 9 may be a Out surface such as the top surface of a desk or the like. The support surface 9 may be other than a flat surface. The leading end portion 724 on the second opening 702 side of the spout 72 (refer to FIG. 5) is positioned toward the inner side of the case 2 from the outer surface 333 of the inclined surface portion 332. Therefore, when the inclined surface portion 332 is in contact with the support surface 9, the spout 72 does not come in contact with the support surface 9.

Figure 8:
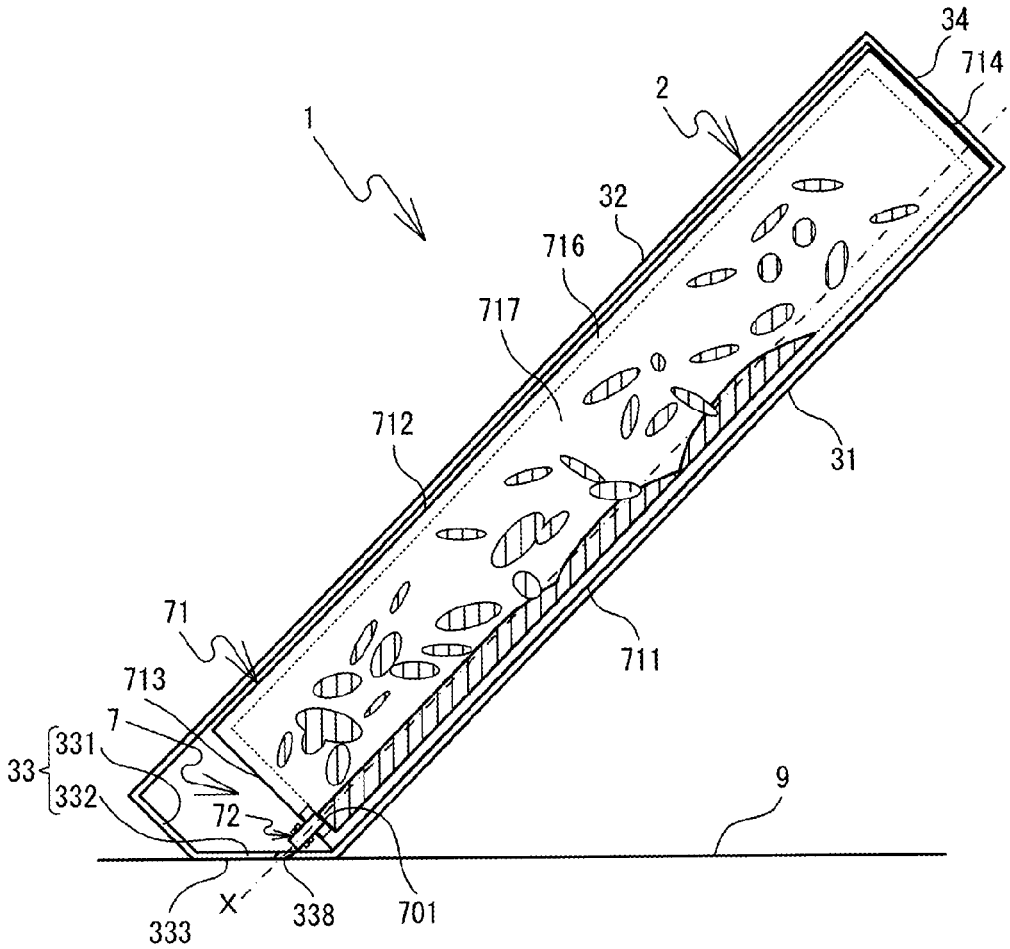
FIG. 8 is another explanatory view showing a process in which the ink is collected by tilting the ink cartridge.

In the ink cartridge 1, the longitudinal direction (the axial line X of the spout 72) of the case 2 and the ink bag 71 may incline with respect to the horizontal direction. At this time, the second opening 702 of the spout 72 may be directed obliquely downward. The first end portion 711 of the ink bag 71 may incline with respect to the horizontal direction. In a similar manner to when the bottom wall 31 is placed on the substantially horizontal placement surface 130, the two layers of sheets that form the ink storage portion 717 may be disposed such that the surfaces of the two layers of sheets extend substantially in the up-down direction. Part of the ink may move in the ink storage portion 717 due to force that is applied when the posture of the ink cartridge 1 is changed. In a state in which the axial line X of the spout 72 is substantially horizontal (refer to FIGS. 4 and 6) before the posture of the ink cartridge 1 is changed, the ink dispersed in the ink storage portion 717 may not move because the inner surfaces of the sheets are in contact with each other. At this time, the direction of the gravitational force applied to the dispersed ink may be substantially perpendicular to the axial line X of the spout 72. On the other hand, when the posture of the ink cartridge 1 is changed as shown in FIG. 8, the direction of the gravitational force applied to the dispersed ink may change to an oblique direction with respect to the axial line X of the spout 72.

After the posture of the ink cartridge 1 has been changed in this manner, the user may continue to hold the ink cartridge 1 in the inclined state for a while. In this case, as shown in FIG. 8, the ink within the ink storage portion 717 may start to move downward along the inner surfaces of the sheets, due to the force of gravity and the movement of the ink that accompanies the above-described change in posture. As described above, the surfaces of the sheets extend almost in the up-down direction, so the ink can move downward smoothly. The ink that has accumulated along the first end portion 711 inside the ink storage portion 717 may flow along the first end portion 711 toward a corner portion where the third end portion 713 and the first end portion 711 meet, because the first end portion 711 is inclined with respect to the horizontal direction. The spout 72 is provided in the vicinity of the third end portion 713. Some of the isolated plurality of ink deposits may start to move downward due to the force of gravity. Some of the ink deposits may converge with other ink deposits in the middle of downward movement, forming larger ink deposits that move downward. In this manner, the ink may flow toward the spout 72 along the first end portion 711.

The axial line X of the spout 72 is positioned closer to one end portion (the end portion on the bottom wall 31 side) of the case 2 in the direction that is orthogonal to the axial line X. The axial line X and the inclined surface portion 332 (the outer surface 333) in the direction to the end portion on the bottom wall 31 side form an acute angle on the inner side of the case 2. Accordingly, when the ink cartridge 1 is inclined such that the inclined surface portion 332 becomes substantially horizontal, the spout 72 is disposed in a position that is closer to the support surface 9. Therefore, the ink may easily collect in the vicinity of the first opening 701 of the spout 72. The axial line X is positioned closer to one end portion (the first end portion 711) of the ink bag 71 in the direction that is orthogonal to the axial line X. Taking the axial line X as a boundary, the width of the ink bag 71 on the first end portion 711 side is less than the width of the ink bag 71 on the opposite side. Therefore, when the ink cartridge 1 is inclined such that the inclined surface portion 332 becomes substantially horizontal, the ink may easily collect in the vicinity of the first opening 701 of the spout 72.

Figure 9:
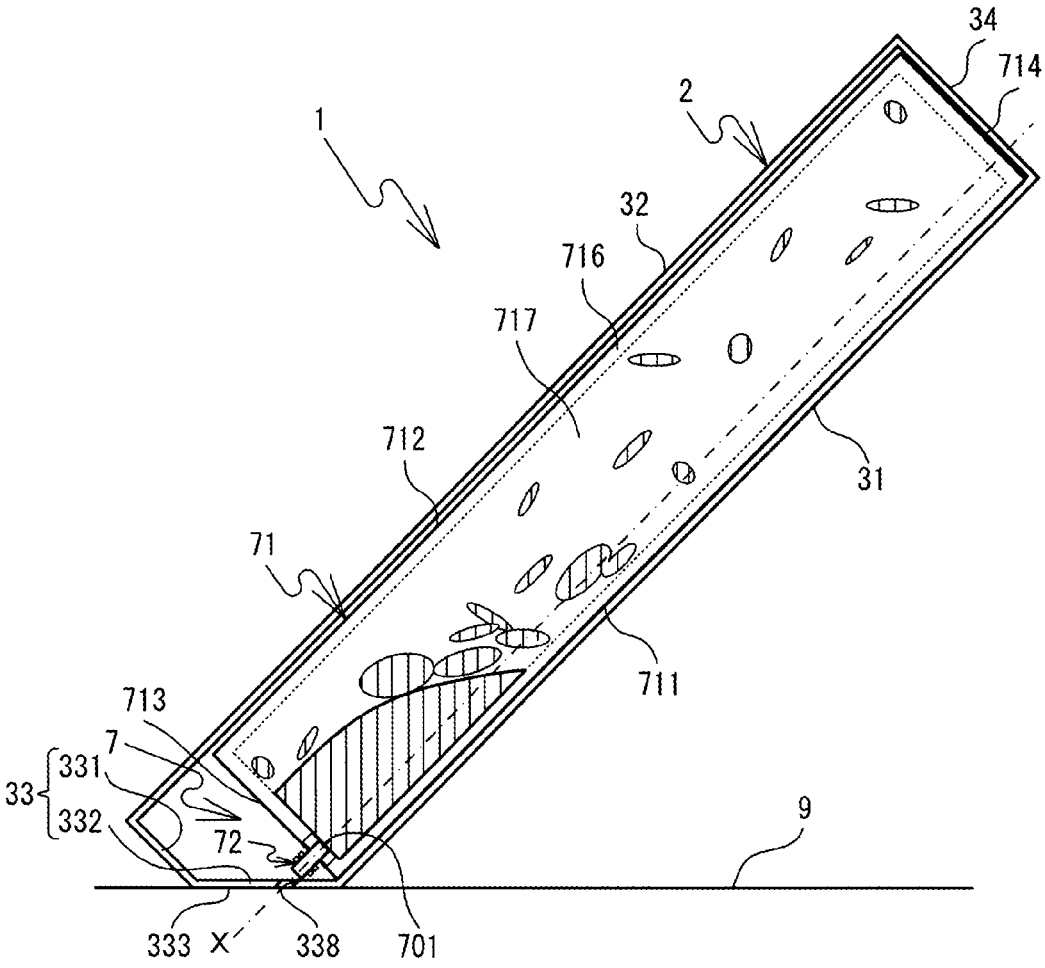
FIG. 9 is yet another explanatory view showing a process in which the ink is collected by tilting the ink cartridge.

Further, when the ink cartridge 1 continues to be inclined, as shown in FIG. 9, most of the ink that remained in the form of ink deposits in various locations inside the ink storage portion 717 may gather in the vicinity of the first opening 701 of the spout 72. In this state, most of the inner surfaces of the sheets may be in contact with each other in the fourth end portion 714 of the ink bag 71 and the vicinity of the fourth end portion 714. In the longitudinal direction of the ink bag 71, the fourth end portion 714 is located on the side opposite to the side where the spout 72 is provided.

In the state in which the ink is collected in the vicinity of the first opening 701 in this manner, the user may set the ink cartridge 1 in the inkjet printer 100 again, with the wall surface 31 being on the lower side, as shown FIG. 6. As shown in FIG. 9, more ink may be collected in the vicinity of the first opening 701 as compared to the state shown in FIG. 7. In addition, in the fourth end portion 714 of the ink bag 71 and the vicinity of the fourth end portion 714, most of the inner surfaces of the two sheets may be in contact with each other. Therefore, even when the bottom wall 31 is placed on the placement surface 130 and the first end portion 711 is positioned substantially horizontally, it is possible to inhibit to some extent the movement of the ink from the vicinity of the first opening 701 toward the fourth end portion 714. As a result, it is possible to maintain a state in which the ink surface is above the hole of the leading end portion of the hollow needle 141 that has pierced the rubber plug 723. Thus, the remaining ink can be supplied to the print head 114.

As explained above, in the ink cartridge 1 of the present embodiment, the inclined surface portion 332 is provided in the case 2, which houses the ink bag 71. The inclined surface portion 332 is provided such that the inclined surface portion 332 is inclined in relation to the axial direction of the spout 72. In a case where the amount of the remaining ink is small, the user can hold the ink cartridge 1 into a stable inclined state in relation to the horizontal direction, using the inclined surface portion 332 as described above. When the user holds the ink cartridge 1 in the air, there is a possibility that the ink cartridge 1 will slip from the user's hand for some reason and be dropped. At this time, if the ink cartridge 1 is in a posture in which the spout 72 is positioned on the upper side, the flow of the ink toward the spout 72 may be inhibited. However, as described above, the ink cartridge 1 is adapted for placing the inclined surface portion 332 on the substantially horizontal support surface 9. Therefore, when the inclined surface portion 332 is placed on the support surface 9, the downward flow of the ink by the force of gravity may be stabilized. Accordingly, the possibility that a force in the completely opposite direction will be applied to the ink may be reduced. It is therefore possible for the ink remaining in the ink bag 71 to collect efficiently toward the spout 72. In addition, the ink cartridge 1 can easily be held in an inclined state by placing the inclined surface portion 332 on a support surface such as a desktop or the like. Therefore, less strength may be required of the user than in a case where the user grasps the ink cartridge 1 in an inclined state in the air, making the ink cartridge 1 more convenient for the user.

In many cases, a pigment ink that contains a pigment is used as the ink for the inkjet printer 100. In other words, in many cases, the ink bag 71 in the ink cartridge 1 is filled with a pigment ink. There is a possibility that some of the pigments in the pigment inks, such as titanium oxide, may precipitate. If the ink cartridge 1 is shaken and the ink in the ink bag 71 is agitated, the ink may be scattered over a wide range within the ink storage portion 717. Even in this sort of case, it is possible to collect the remaining ink toward the spout 72 by using the inclined surface portion 332 to put the ink cartridge 1 into the inclined state. It is therefore possible to reduce wasting of the ink. In a white ink that contains titanium oxide, the titanium oxide is likely to precipitate. However, according to the ink cartridge 1 of the present embodiment, the axial direction of the spout 72 may be inclined in relation to the horizontal direction by putting the ink cartridge 1 into the inclined state using the inclined surface portion 332. Accordingly, titanium oxide is less likely to precipitate in the first opening 701 of the spout 72 than in a case where the axial line X is oriented vertically. It is therefore possible to inhibit a state from occurring in which the ink becomes unsuitable for use in printing because titanium oxide precipitates in the first opening 701 and the ink composition divides into two parts.

An emulsion ink that contains an emulsion is also used in many cases as the ink for the inkjet printer 100. An emulsion ink has a higher viscosity than does an ink that does not contain an emulsion. Accordingly, even when the ink cartridge 1 is inclined, the ink is more resistant to moving, and it may take time for the ink to collect downward. According to the ink cartridge 1 of the present embodiment, it is possible to hold the ink cartridge 1 easily in an inclined state by placing the inclined surface portion 332 on a support surface such as a desktop or the like. This is particularly advantageous in comparison to a case in which the user holds the ink cartridge 1 in the air for a long time. In addition, in a case where the emulsion ink also contains titanium oxide, it is possible for the emulsion ink to collect efficiently while the precipitation of titanium oxide in the first opening 701 of the spout 72 is inhibited, as described above.

The case 2 includes the inclined surface portion 332. It is therefore possible to alleviate an impact that is received by the spout 72 when the ink cartridge 1 is dropped. Specifically, the corner portion where the inclined surface portion 332 of the case 2 connects to the bottom wall 31 forms an obtuse angle. The spout 72 is disposed in the vicinity of the corner portion. When an impact is applied to this sort of obtuse angle corner portion, stress is less likely to concentrate on the obtuse angle corner portion than in the case of a right angle corner portion. Therefore, the possibility that a strong impact will be applied to the corner portion, damaging the spout 72 that is located in the vicinity and significantly displacing the disposed position of the spout 72, can be reduced in comparison with a right angle corner portion. Further, it is assumed that, at the time of shipment, for example, the ink cartridge 1 is packed in a rectangular box of almost the same size as the ink cartridge 1.

In this sort of case, a triangular prism-shaped space is formed between the inclined surface portion 332 and the box. Therefore, even if the box is dropped, for example, and the ink cartridge 1 receives an impact, the space may serve as a cushion. The impact that the spout 72 receives may be thus alleviated.

As shown in FIG. 5, in a state in which the axial line X of the spout 72 of the ink cartridge 1 is substantially horizontal, the upper surface (the inner surface) of the inclined surface portion 332 projects in the leading end direction of the leading end portion 724, extending to below the leading end portion 724. Therefore, even if the ink drops downward from the leading end portion 724 when the hollow needle 141 is pulled out from the spout 72, the ink may strike the upper surface of the inclined surface portion 332. The ink may move toward the inner side (the first opening 701 side) of the ink cartridge 1 along the slope of the inclined surface portion 332. Therefore, contamination of the area around the ink cartridge 1 by the ink may be inhibited.

Not only when the hollow needle 141 for supplying ink to the inkjet printer 100 is pulled out from the spout 72, the contamination prevention effect can also be expected in another case. For example, also when a hollow needle that is used to initially fill, add, or refill ink to the ink bag 71 is pulled out, ink may drop. Therefore, also in this type of case, a similar effect can be expected. In the state shown in FIG. 5, in a case where the ink adheres to the leading end portion 724 in accordance with insertion and removal of the hollow needle 141, the ink may be located on a lower end portion of the leading end portion 724. In that ink state, if the ink cartridge 1 is inclined as shown in FIG. 9, the upper surface (the inner surface) of the inclined surface portion 332 is located below the lower end portion of the leading end portion 724 in the state shown in FIG. 5. Therefore, even when the ink drops downward from the leading end portion 724, the ink may strike the upper surface of the inclined surface portion 332. Thus, it is possible to suppress the vicinity of the ink cartridge 1 from being contaminated with the ink.

Figure 10:
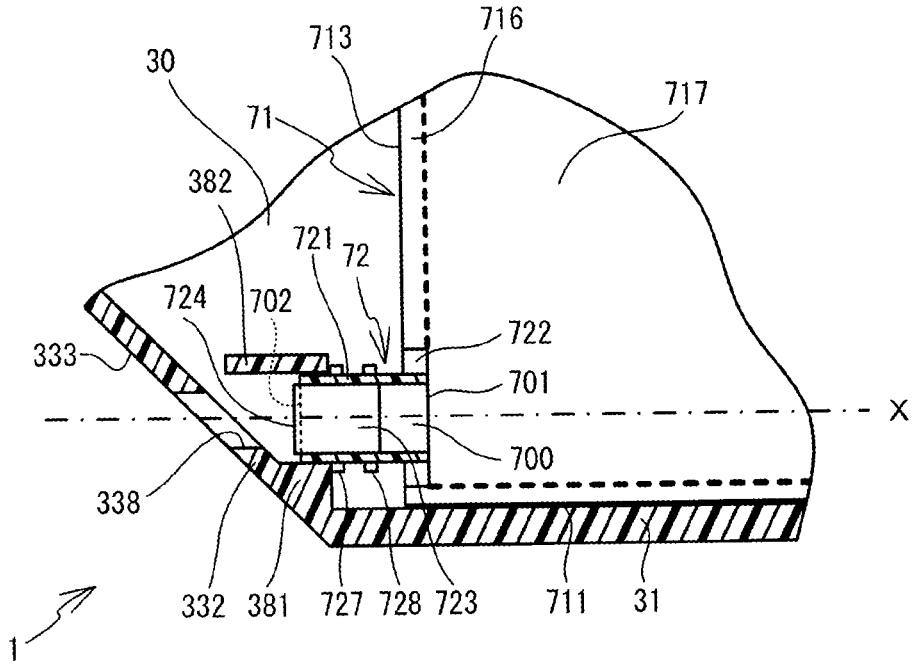
FIG. 10 is an enlarged vertical cross-sectional view of a spout surrounding portion of the ink cartridge with which fixing portions are provided.

An fixing portion for the spout 72 in the case 2 may also be provided in the ink cartridge 1 for reliably disposing the spout 72 in an accurate position in relation to the inclined surface portion 332 of the case 2. A modified example in which this sort of fixing portion is provided in the ink cartridge 1 will be explained with reference to FIGS. 10 and 11. As shown in FIG. 10, a portion that is positioned on the inner surface of the inclined surface portion 332 between the penetration portion 338 and the corner portion where the inclined surface portion 332 and the bottom wall 31 meet projects toward the inside of the case 2. This projecting portion is a fixing portion 381. The surface on the penetration portion 338 side of the fixing portion 381 (the upper surface) is a curved surface that conforms to the outer circumferential shape of the body portion 721 of the spout 72. The two flanges 727, 728 are provided on the outer circumference of the body portion 721. Of the two flanges 727, 728, the projecting edge of the fixing portion 381 is in contact with the flange 727, which is closer to the leading end portion 724, on the side face that is on the leading end portion 724 side of the flange 727. A fixing portion 382 is a piece that projects toward the inside of the case 2 from the right wall 30. The fixing portion 382 is provided such that the fixing portion 382 faces the fixing portion 381, with the spout 72 between the fixing portions 381 and 382. The projecting edge of the fixing portion 382 is in contact with the flange 727, which is closer to the leading end portion 724, on the side face that is on the leading end portion 724 side of the flange 727. The leading end portion 724 is positioned such that a clearance is provided in the axial line X direction in relation to the inner surface (the right surface in FIG. 10) of the inclined surface portion 332. The inclined surface portion 332 extends upward toward the penetration portion 338 from the left side of the fixing portion 381 in FIG. 10. Accordingly, it is possible for the ink to accumulate between the inclined surface portion 332 and the leading end portion 724.

Therefore, the spout 72 can be positioned and fixed in place using the fixing portions 381, 382. The spout 72 can thus be reliably disposed in an accurate position in relation to the case 2, such that the second opening 702 is opposite the penetration portion 338, the leading end portion 724 is disposed toward the inner side of the case 2 from the outer surface 333 of the inclined surface portion 332, and the axial line X is inclined in relation to the outer surface 333. In some cases, such as when the ink cartridge 1 is removed from the inkjet printer 100 and the like, the ink cartridge 1 may be disposed such that the bottom wall 31 faces downward. In these sorts of cases, it may be possible for the ink that falls from the spout 72 to be received by the upper surface of the fixing portion 381, which extends substantially horizontally in the axial line X direction. The possibility that the ink will leak to the outside of the case 2 can thus be reduced.

Figure 11:
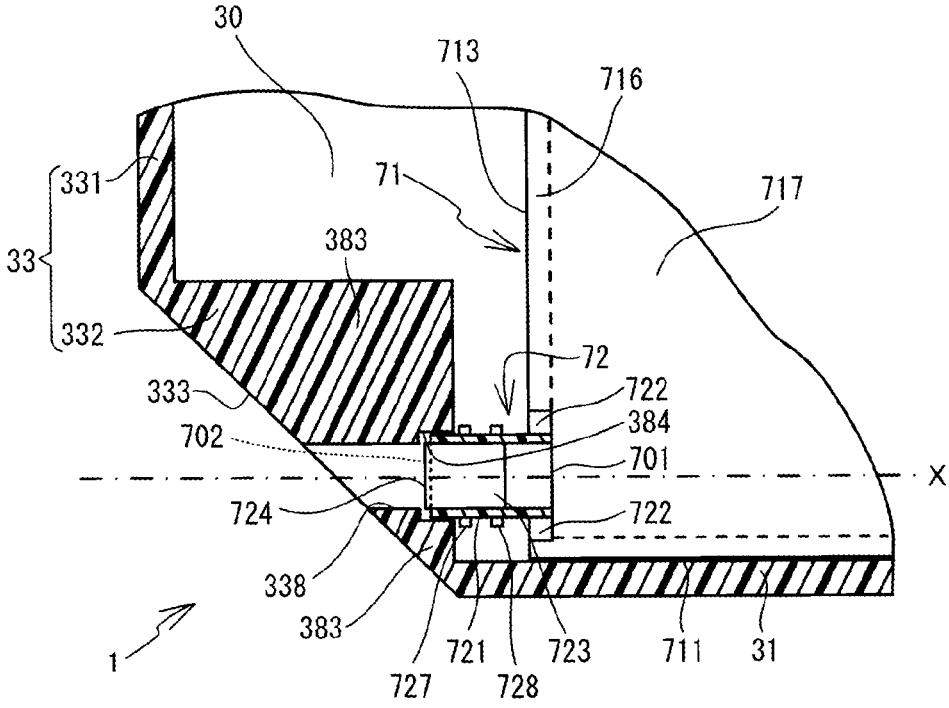
FIG. 11 is an enlarged vertical cross-sectional view of the spout surrounding portion of the ink cartridge with which a fixing portion is provided.

As shown in FIG. 11, a fixing portion may also be formed such that the fixing portion is continuous only with the inclined surface portion 332. Specifically, a fixing portion 383 that projects toward the inner side of the case 2 such that the fixing portion 383 surrounds the penetration portion 338 may be provided on the inner surface of the inclined surface portion 332. A cylindrical recessed portion 384 may also be provided on the inner surface side of the fixing portion 383, on the same axis as that of the penetration portion 338. The recessed portion 384 may have a cylindrical shape that corresponds to the external shape of the body portion 721 of the spout 72. The depth of the recessed portion 384 may be substantially the same as the length from the leading end portion 724 of the spout 72 to the side face on the leading end portion 724 side of the flange 727, which is closer to the leading end portion 724. In that case, a portion of the leading end portion 724 side of the spout 72 can be fitted into the recessed portion 384 of the fixing portion 383. In this manner, the spout 72 can be positioned and fixed in place. The spout 72 can thus be reliably disposed in an accurate position in relation to the case 2, such that the second opening 702 is opposite the penetration portion 338, the leading end portion 724 is disposed toward the inner side of the case 2 from the outer surface 333 of the inclined surface portion 332, and the axial line X is inclined in relation to the outer surface 333.

The leading end portion 724 is positioned such that, within the recessed portion 384 that is provided in the fixing portion 383, a clearance in relation to the outer surface 333 is provided in the axial line X direction. Accordingly, it is possible for the ink to accumulate between the outer surface 333 and the leading end portion 724. In some cases, such as when the ink cartridge 1 is removed from the inkjet printer 100, the ink cartridge 1 may be disposed such that the bottom wall 31 faces downward. In these sorts of cases, it is possible for the ink that falls from the spout 72 to be received by the fixing portion 383 below the penetration portion 338, which extends substantially horizontally in the axial line X direction. The possibility that the ink will leak to the outside of the case 2 can therefore be reduced. The leading end portion 724 is positioned such that a clearance is also provided in relation to the recessed portion 384 of the fixing portion 383 in the axial line X direction. Accordingly, it is possible for the ink to accumulate between the recessed portion 384 and the leading end portion 724. In some cases, such as when the ink cartridge 1 is removed from the inkjet printer 100, the ink cartridge 1 may be disposed such that the bottom wall 31 faces downward. In these sorts of cases, it is possible for the ink that falls from the spout 72 to be received by the clearance between the leading end portion 724 and the fixing portion 383 below the recessed portion 384, which extends substantially horizontally in the axial line X direction. The possibility that the ink will leak to the outside of the case 2 can therefore be reduced.

Figure 2:
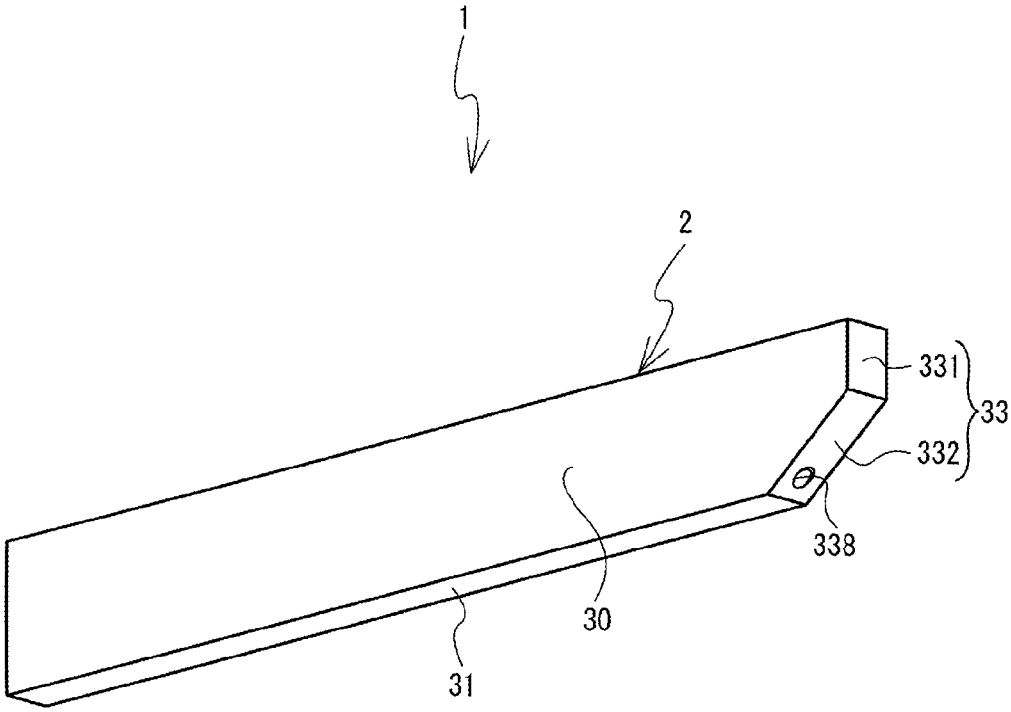
FIG. 2 is a perspective view of an ink cartridge of a first embodiment as seen from the rear right.

The shape of the case 2 of the ink cartridge 1 is not limited to the shape that was explained above. As long as the case 2 includes the inclined surface portion 332 and the positional relationship between the case 2 and the ink pack 7 is specified as described above, various types of modifications can be made to the shape of the case 2. For example, as in an ink cartridge 11 that is shown in FIG. 12, the length of the case 2 in the longitudinal direction (the front-rear direction) may be made shorter than it is in the ink cartridge 1 that is shown in FIG. 2.

The positional relationship between the case 2 and the ink pack 7 in the ink cartridge 11 is basically the same as it is in the ink cartridge 1 that is shown in FIG. 4, except that the case 2 of the ink cartridge 11 is shorter. In other words, even in the ink cartridge 11, the ink pack 7 is housed in the case 2 such that the two layers of the sheets that form the ink bag 71 extend substantially parallel to the virtual plane that includes the axial line X of the spout 72 and that forms a right angle with the outer surface 333 of the inclined surface portion 332. The ink pack 7 is housed in the case 2 such that the spout 72 is disposed close to one end portion of the case 2 in the direction that is orthogonal to the axial line X, and the axial line X is inclined in relation to the outer surface 333 of the inclined surface portion 332. The second opening 702 of the spout 72 is opposite the penetration portion 338 that is provided in the inclined surface portion 332. The leading end portion 724 of the spout 72 is disposed toward the inner side of the case 2 from the outer surface 333 of the inclined surface portion 332.

Figure 12:
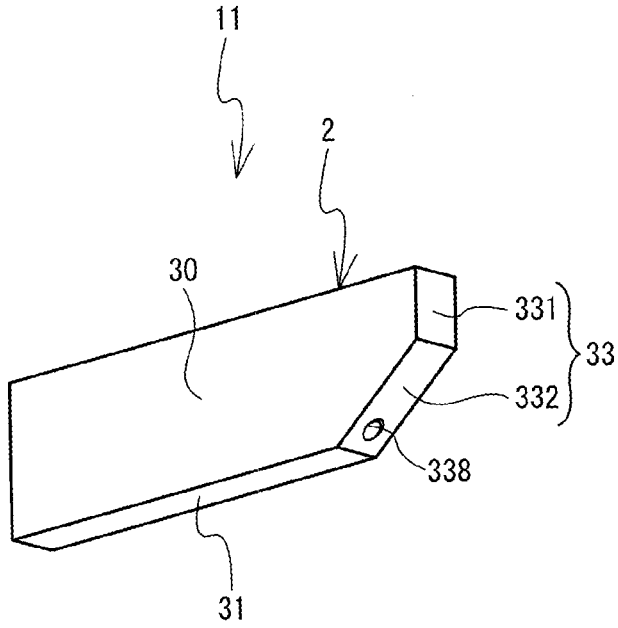
FIG. 12 is an oblique view of the ink cartridge according to a modified example, as seen from the right rear.

In the ink cartridge 11 that is shown in FIG. 12, in the same manner as in the ink cartridge 1, this sort of structure makes it possible, in a case where the amount of the remaining ink is small, for the ink that remains to be collected efficiently toward the first opening 701 of the spout 72 by using the inclined surface portion 332. In a case where the ink cartridge 1 that is shown in FIG. 2 is put into a slanting posture with the inclined surface portion 332 placed on the support surface 9, as shown in FIG. 7, if the user does not grasp the ink cartridge 1, given the dimensional balance of the case 2, the ink cartridge 1 may not sustain the slanting posture and may fall over. In contrast, the length of the longitudinal direction of the case 2 of the ink cartridge 11 that is shown in FIG. 12 is short. Therefore, in a case where the ink cartridge 11 is put into a slanting posture with the inclined surface portion 332 placed on the support surface 9, the ink cartridge 11 may maintain a state in which the ink cartridge 11 sustains the slanting posture without being grasped by the user.

FIGS. 13 to 16 show an ink cartridge 12 according to a modified example that includes a case 2 of yet another shape. In the same manner as the ink cartridge 1 that is shown in FIG. 2, the ink cartridge 12 includes the case 2 that has a thin, substantially rectangular box shape. The case 2 includes the right wall 30, the peripheral walls 31 to 34, and the lid portion 4. However, in the case 2 of the ink cartridge 12, the rear wall 33 that includes the rear surface portion 331 and the inclined surface portion 332 is continuous with the lid portion 4, not with the right wall 30. The bottom wall 31, the upper wall 32, and the front wall 34 are continuous with the right wall 30.

Figure 13:
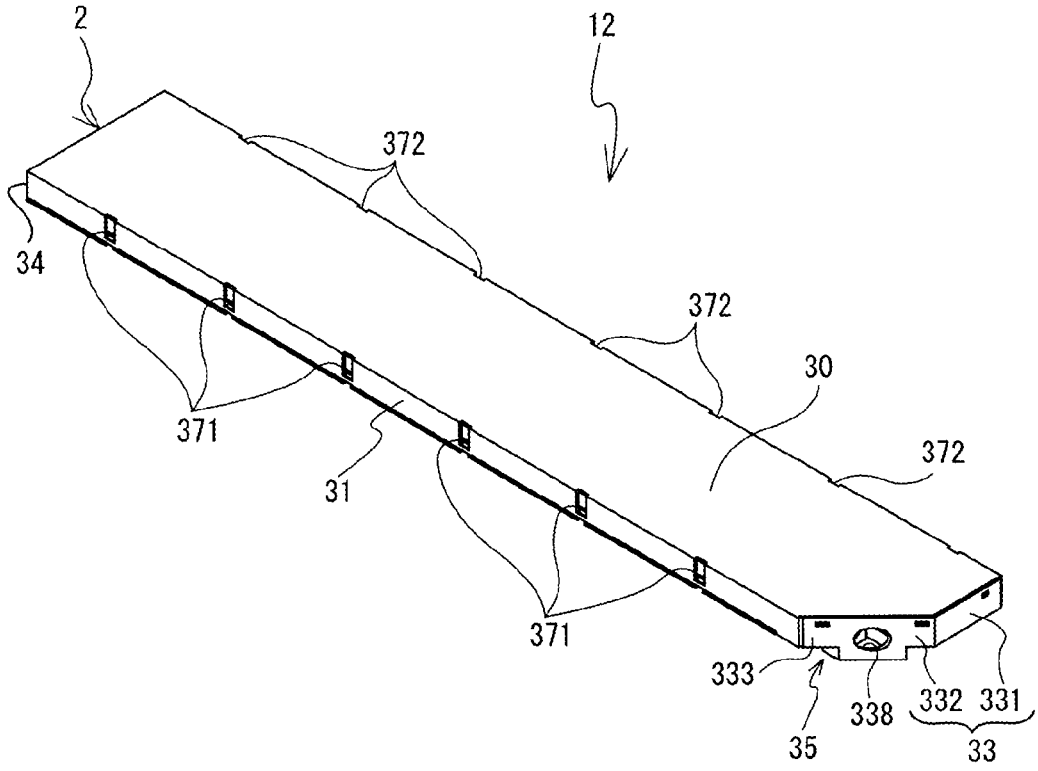
FIG. 13 is an oblique view of the ink cartridge according to another modified example, as seen from the right rear.
Figure 14:
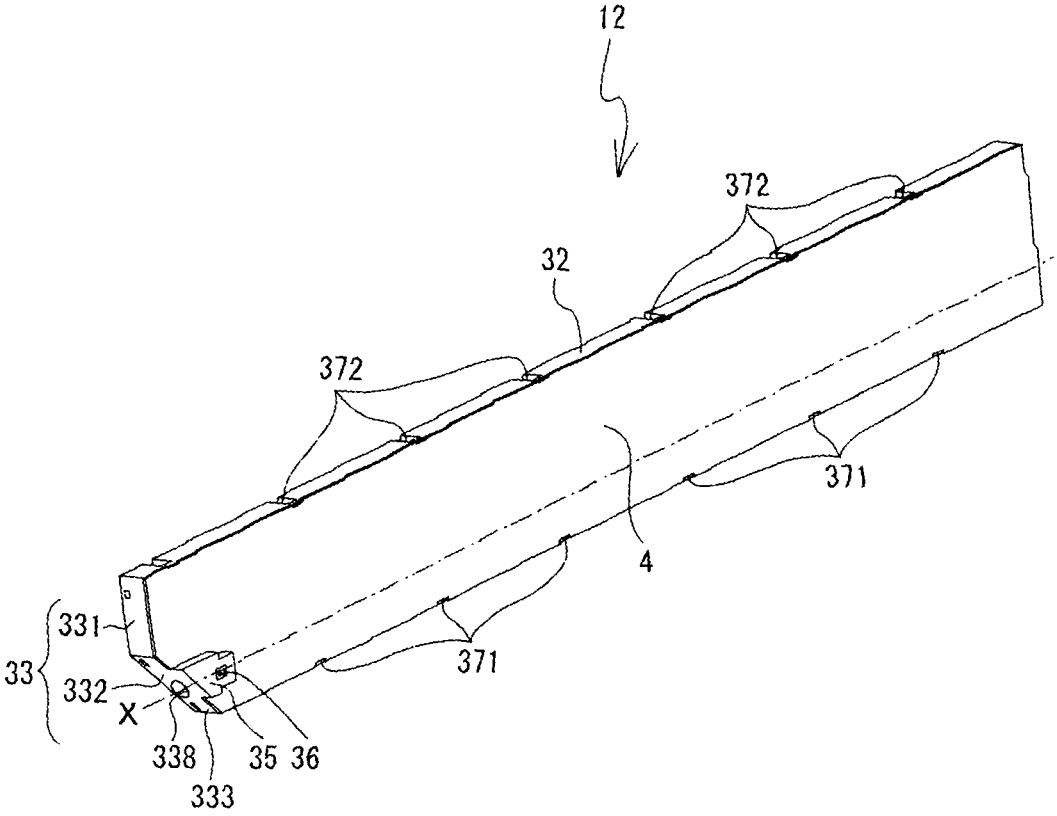
FIG. 14 is an oblique view of the ink cartridge, as seen from the left rear.
Figure 15:
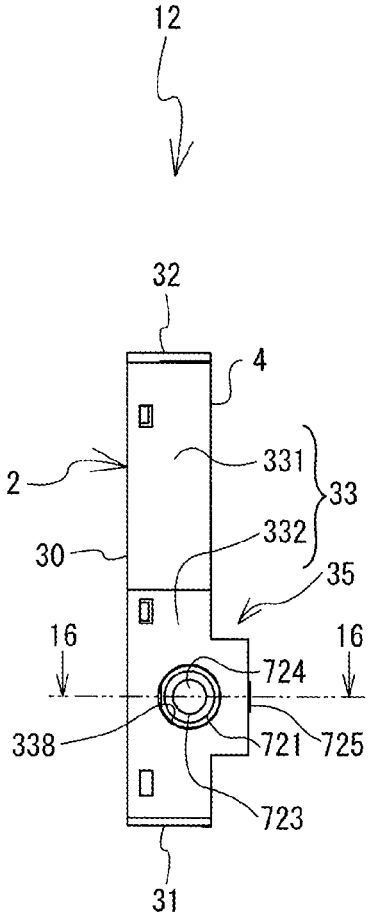
FIG. 15 is a rear view of the ink cartridge.
Figure 16:
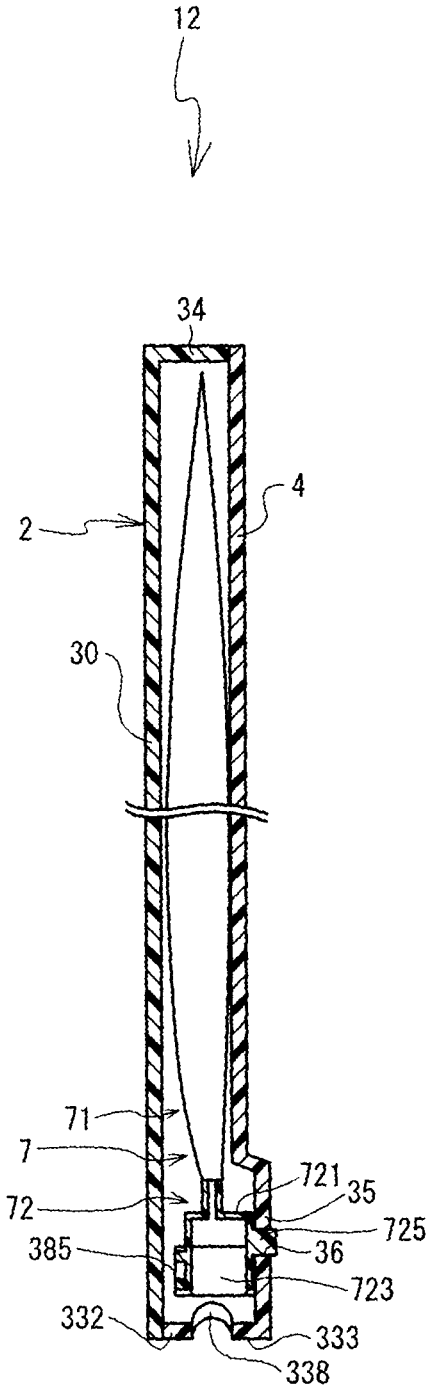
FIG. 16 is a cross-sectional view in the direction of arrows 16 in FIG. 15.

As shown in FIGS. 13 to 16, a projecting portion 35 is provided in a central portion of the portion where the lid portion 4 connects to the inclined surface portion 332. The projecting portion 35 is formed by making the plate-shaped member that forms the lid portion 4 project to the left from the left side face of the case 2. The length of the projecting portion 35 in the longitudinal direction of the case 2 is slightly longer than the length of the spout 72. In the present modified example, the inclined surface portion 332 is formed such that the inclined surface portion 332 is continuous with the lid portion 4. Therefore, in the portion where the inclined surface portion 332 connects with the projecting portion 35, the width of the inclined surface portion 332 (the equivalent of the distance between the right side face and the left side face of the case 2) is wider than it is in other portions. The penetration portion 338 is provided in the portion where the width is wider. As shown in FIGS. 14 and 16, a rectangular engaging hole 36 is provided in the center of the projecting portion 35. As shown in FIG. 16, a pair of fixing portions 385 are provided on the bottom wall 31 side and the upper wall 32 side of the spout 72 (in FIG. 16, only the fixing portion 385 on the bottom wall 31 side is shown). The pair of the fixing portions 385 are pieces that project from the inner surface of the projecting portion 35 toward the inner side of the case 2. Of the fixing portions 385, the fixing portion 385 on the bottom wall 3) side is also continuous with the inclined surface portion 332.

As shown in FIGS. 13 and 14, the bottom wall 31 and the upper wall 32 are disposed opposite one another in the longitudinal direction (the front-rear direction) of the case 2. Six recessed portions 371 and six recessed portions 372 are provided in the bottom wall 31 and the upper wall 32, respectively. The six recessed portions 371 are positioned opposite the corresponding six recessed portions 372, with the axial line X of the spout 72 in between the six recessed portions 371 and the corresponding six recessed portions 372.

The positional relationship between the case 2 and the ink pack 7 in the ink cartridge 12 is basically the same as it is in the ink cartridge 1 that is shown in FIG. 4. In other words, even in the ink cartridge 12, the ink pack 7 is housed in the case 2 such that the two layers of the sheets that form the ink bag 71 extend substantially parallel to the virtual plane that includes the axial line X of the spout 72 and that forms a right angle with the outer surface 333 of the inclined surface portion 332. The ink pack 7 is housed in the case 2 such that the spout 72 is disposed close to one end portion of the case 2 in the direction that is orthogonal to the axial line X, and the axial line X is inclined in relation to the outer surface 333 of the inclined surface portion 332. The second opening 702 of the spout 72 is opposite the penetration portion 338 that is provided in the inclined surface portion 332. The leading end portion 724 of the spout 72 is disposed toward the inner side of the case 2 from the outer surface 333 of the inclined surface portion 332. In the ink cartridge 12, the penetration portion 338 is provided approximately in the center of the inclined surface portion 332. Looking at the entire case 2, the penetration portion 338 is positioned closer to the spout side end portion (the bottom wall 31) in the direction that is orthogonal to the axial line X.

As shown in FIG. 16, a rectangular columnar engaging projecting portion 725 is provided on a portion of the outer surface of the spout 72 of the ink pack 7. The engaging projecting portion 725 is a rectangular column that projects toward the outer side in the circumferential direction. The engaging projecting portion 725 fits into the engaging hole 36 that is provided in the projecting portion 35 of the lid portion 4. The spout 72 is held between the above-described pair of the fixing portions 385. The spout 72 is thus fixed in a position on the inner side of the projecting portion 35 of the case 2.

Thus, even in the ink cartridge 12, the spout 72 can be reliably disposed in an accurate position in relation to the case 2. In the ink cartridge 12, the lid portion 4 includes the inclined surface portion 332, so the spout 72 is fixed to the lid portion 4 instead of to the body portion 3. It is therefore desirable for the ink bag 71 to be affixed to the inner surface of the lid portion 4 by an adhesive or by double-sided adhesive tape, such that the entire ink pack 7 can be handled as a single unit with the lid portion 4.

In the ink cartridge 12, in the same manner as in the ink cartridge 1, the structure that is described above makes it possible, in a case where the amount of the remaining ink is small, for the ink that remains to be collected efficiently toward the spout 72 by using the inclined surface portion 332. At this time, the user can prevent the ink cartridge 12 from slipping by placing the user's finger in at least one of the recessed portions 371 and 372 that are respectively provided in the bottom wall 31 and the upper wall 32, which are opposing side faces of the case 2. The ink cartridge 12 can therefore be held stably in an inclined state. The recessed portions 371 and 372 are portions of hooks for joining the bottom wall 31 and the upper wall 32, respectively, to the lid portion 4. In the example that is described above, six of each of the recessed portions 371 and the recessed portions 372 are provided. However, it is acceptable for only one pair of the recessed portion 371 and the recessed portion 372 to be provided, one for each of the bottom wall 31 and the upper wall 32, respectively.

In the ink cartridge 12, the projecting portion 35 is provided in the lid portion 4. Accordingly, the width of the case 2 can be increased in accordance with the diameter of the spout 72 only in the area where the spout 72 is disposed, while the width of the case 2 (the distance from the right side face to the left side face) is kept as narrow as possible. It is therefore possible to give the case 2 as a whole a compact shape that is as thin as possible. Moreover, in a case where the user has dropped the ink cartridge 12 onto the ground, for example, a clearance is created between the lid portion 4 and the ground if the projecting portion 35 is on the bottom side. Accordingly, the ink cartridge 12 may be easy for the user to pick up. If the projecting portion 35 is on the upper side, the user can pick up the ink cartridge 12 by the projecting portion 35 and can move the ink cartridge 12 by placing the user's finger against the projecting portion 35. The freedom of handling of the ink cartridge 12 may therefore be improved.

The case 2 of the above-described ink cartridge 1 is an example in which the area around the ink pack 7, except for the penetration portion 338, is covered by the right wall 30, the peripheral walls 31 to 34, and the lid portion 4. However, it is not necessary for the case 2 to cover the entire area around the ink pack 7 in this manner. Specifically, at least one of the wall surfaces can be omitted, as long as the case 2 includes the inclined surface portion 332 and the positional relationship between the case 2 and the ink pack 7 can be specified as described above.

For example, the case 2 may be provided with only the right wall 30, the bottom wall 31, the rear wall 33 (the rear surface portion 331 and the inclined surface portion 332), the front wall 34, and the lid portion 4, without the upper wall 32. Even if there is no upper wall 32, the user is able to place the outer surface 333 of the inclined surface portion 332 on the support surface 9 and hold the ink cartridge. Accordingly, the ink cartridge can be put into an inclined state in relation to the support surface 9. Therefore, even this sort of ink cartridge is able to demonstrate the same sort of effect as the ink cartridge 1 of the first embodiment.

It is possible to omit one or more of the right wall 30, the bottom wall 31, the rear surface portion 331, the front wall 34, and the lid portion 4 in the same manner. However, from the standpoint of ensuring the strength of the case 2 and protecting the ink pack 7, it is preferable for at least one of the surface portions that are continuous with the inclined surface portion 332 to be provided in the case 2. For example, it is acceptable for the case 2 to have the right wall 30 and the lid portion 4 connected to the inclined surface portion 332. In this case, in the same manner as in the embodiment that is described above, the ink that remains can be efficiently collected toward the spout 72 by using the inclined surface portion 332. The ink bag 71 is disposed between the right wall 30 and the lid portion 4, whose surface areas are greater than that of the inclined surface portion 332. It is therefore possible to maintain the posture of the ink bag 71 in a stable state, even with the ink cartridge in an inclined state. Even in a case where at least one of the wall surfaces have been omitted as in the example that is described above, a fixing portion of the spout 72 may be provided in the case 2, as shown in FIGS. 10 and 11.

In the embodiment that is described above, an example has been explained in which the rear wall 33 includes the rear surface portion 331 and the inclined surface portion 332, the rear surface portion 331 forms a right angle with the upper wall 32, the inclined surface portion 332 connects to the rear surface portion 331 and the bottom wall 31, and the inclined surface portion 332 forms an obtuse angle with each of the rear surface portion 331 and the bottom wall 31. In this case, it is possible to prevent the longitudinal direction of the case 2 from becoming unnecessarily long, even as the inclined surface portion 332 is provided for efficiently collecting the ink. In other words, it is possible to reduce wasted space within the case 2 that will not be used. However, the rear wall 33 may include only the inclined surface portion 332 and does not have to include the rear surface portion 331.

In the present embodiment, an example has been explained in which the outer surface 333 of the inclined surface portion 332 is a flat surface, but the outer surface 333 does not necessarily have to be a flat surface. It is acceptable for the outer surface 333 to be a surface that is able to make contact with a flat surface at a minimum of two points, or along a line or a plane. For example, the outer surface 333 may be a curved surface, an undulating surface, or the like that extends at an angle in relation to the axial line X. In this case, it is acceptable for the angles $\theta 1$, $\theta 2$ that are formed by the axial line X of the spout 72 and the outer surface 333 to be expressed as angles that are formed by the axial line X and a virtual plane that is specified as a plane that is tangent to the outer surface 333.

In the embodiment that is described above, an example is provided in which the opening diameter of the penetration portion 338 is approximately equal to the diameter of the second opening 702 of the spout 72. However, the penetration portion 338 needs only to be provided in a position that is opposite the second opening 702. It is necessary only to ensure that the opening diameter of the penetration portion 338 is a diameter that, at a minimum, allows the hollow needle 141 of the connection portion 140 to pierce the rubber plug 723 of the spout 72. Accordingly, the opening diameter of the penetration portion 338 may be smaller than the diameter of the second opening 702 of the spout 72. Conversely, the opening diameter of the penetration portion 338 may be larger than the diameter of the second opening 702.

Second Embodiment

The ink cartridge 1 that was used as an example in the first embodiment, and the ink cartridges 11 and 12 according to the modified examples (refer to FIGS. 2, 12, and 13) are ink supply parts that can be set to the inkjet printer 100. When the ink that is stored in the ink pack 7 is consumed, the amount of ink may decrease until the ink cannot be sucked out by the hollow needle 141, even if the ink has been collected around the spout 72 by using the inclined surface portion 332, as described above. In this sort of case, the ink cartridges 1, 11, 12 may be replaced with new ones. However, although the ink in the ink pack 7 is consumed by the printing, the case 2 itself does not incur any particular wear. Therefore, from the standpoint of protecting the environment, it would be preferable if the case 2 could be reused to a certain extent. Accordingly, in a second embodiment, an ink bag unit 201 that is a replacement part for the ink cartridge will be explained.

Figure 17:
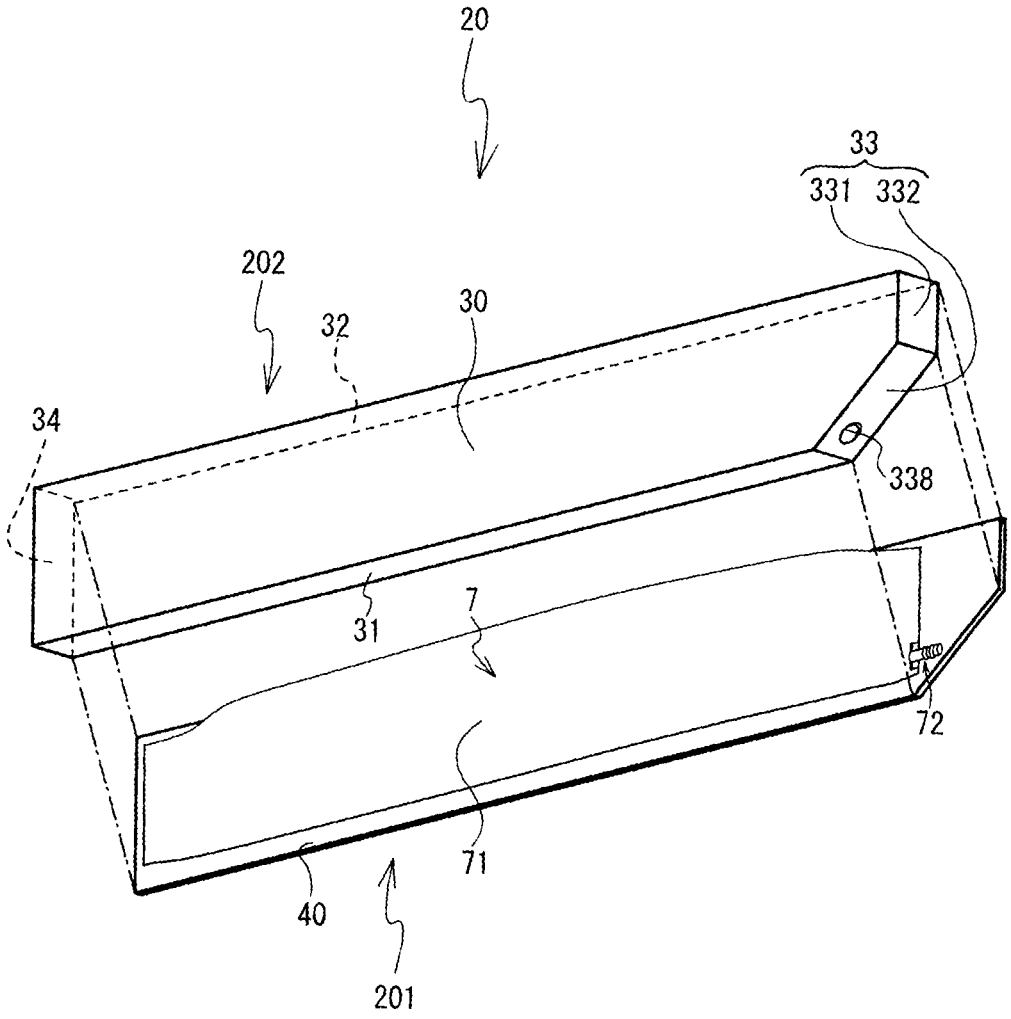
FIG. 17 is an exploded oblique view of an ink cartridge that includes an ink bag unit of a second embodiment.

The structure of the ink bag unit 201 of the present embodiment will be explained with reference to FIGS. 17 to 19. The ink bag unit 201 is equivalent to a unit in which the ink pack 7 is affixed to the lid portion 4 of the ink cartridge 1 of the first embodiment, which is shown in FIG. 3. As shown in FIG. 17, the ink bag unit 201 includes the ink pack 7 and a support plate member 40 that supports the ink pack 7. The ink bag unit 201 may form an ink cartridge 20 by being joined to a case body 202 by an engaging pin and an engaging hole, for example, although not shown in detail in the drawings. The case body 202 is equivalent to the body portion 3 of the ink cartridge 1 of the first embodiment, which is shown in FIG. 3. The case body 202 includes the right wall 30 and the peripheral walls 31 to 34. In the same manner as in the body portion 3, the rear wall 33 includes the rear surface portion 331 and the inclined surface portion 332. The penetration portion 338 is provided in the inclined surface portion 332.

Thus the ink cartridge 20 that is formed from the ink bag unit 201 and the case body 202 is structured in the same manner as the ink cartridge 1 of the first embodiment. Accordingly, the ink cartridge 20 can be set to the inkjet printer 100 that is shown in FIG. 1 and can supply the ink to the print head 114. When the ink has been consumed, the user may remove the ink bag unit 201 from the case body 202 and may replace the removed ink bag unit 201 with anew ink bag unit 201. Accordingly, the case body 202 can be reused.

The ink bag unit 201 will be explained in detail with reference to FIGS. 18 and 19. The structure of the ink pack 7 is the same as that of the ink pack 7 of the ink cartridge 1 of the first embodiment, so an explanation will be omitted below.

Figure 18:
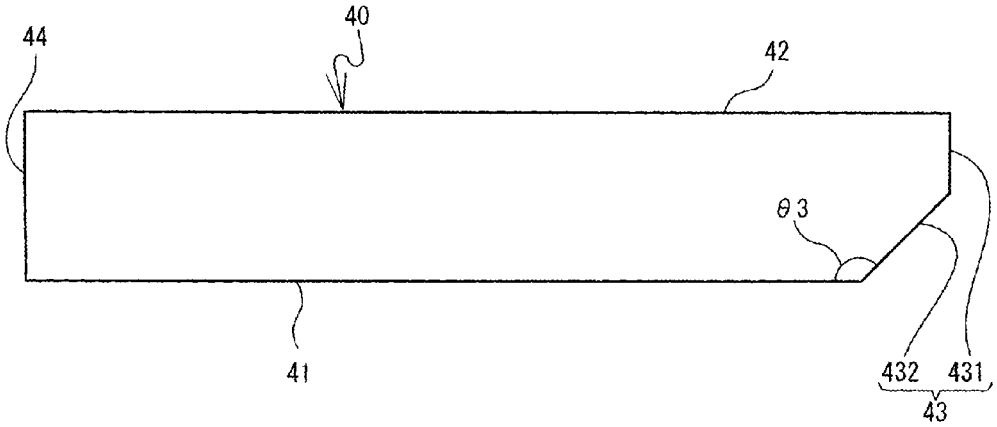
FIG. 18 is a right side view of a support plate member.

As shown in FIG. 18, the support plate member 40 forms a left side face of the ink cartridge 20. When the ink cartridge 20 is viewed from the side, that is, when the ink cartridge 20 is viewed from a direction that is orthogonal to the portion of the support plate member 40 with the greatest surface area (the face that is shown in FIG. 18), the support plate member 40 has a generally pentagonal shape. In a side view, the support plate member 40 has a shape in which, of four corners that form right angles of a rectangle that is long in the front-rear direction, a corner portion that includes the lower rear corner has been cut away at an angle. In other words, in aside view, the support plate member 40 has two opposing parallel long sides that extend in the front-rear direction, two opposing parallel short sides that extend in the up-down direction, and an oblique side that connects the shorter of the long sides and the shorter of the short sides. Hereinafter, the shorter of the long sides, which is a lower end portion of the support plate member 40, is referred to as the first end portion 41, and the longer of the long sides, which is an upper end portion, is referred to as the second end portion 42. The rear end portion of the support plate member 40 is referred to as the third end portion 43, and the longer of the short sides, which is a front end portion, is referred to as the fourth end portion 44. Within the third end portion 43, the portion that is the shorter of the short sides is referred to as the vertical portion 431. The oblique side portion that connects the vertical portion 431 and the first end portion 41 is referred to as the oblique side portion 432. An angle θ3 that is formed by the first end portion 41 and the oblique side portion 432 is an obtuse angle that is greater than 90 degrees.

Figure 19:
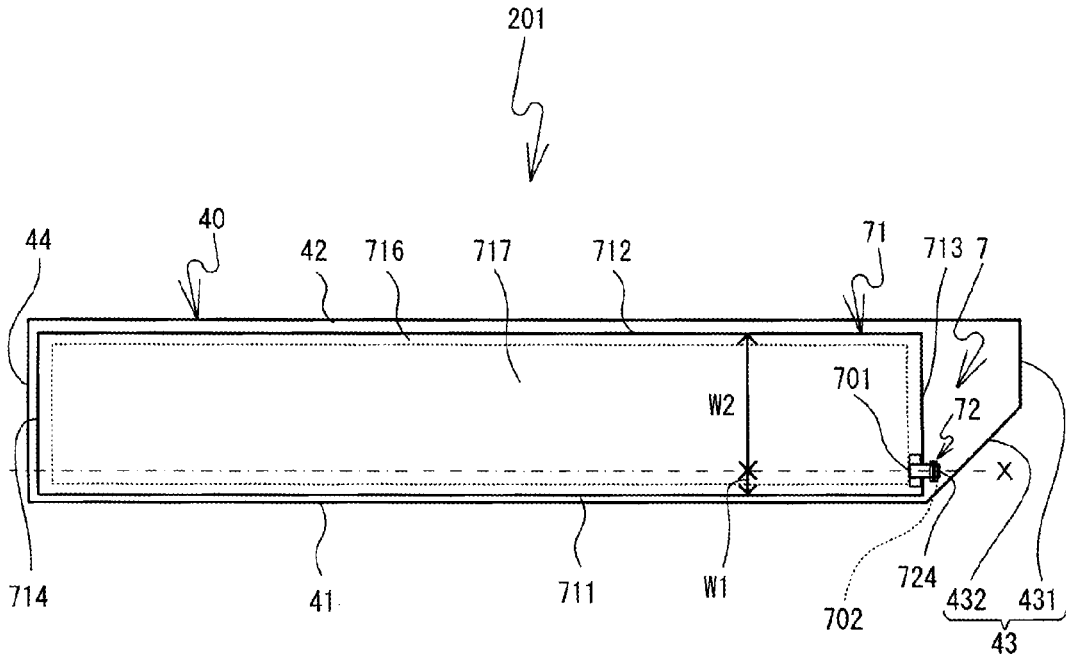
FIG. 19 is an explanatory view showing the ink bag unit as seen from the right side.

As shown in FIG. 19, in the ink pack 7, the outer surface of one of the two layers of the sheets that form the ink storage portion 717 is affixed to the right face of the support plate member 40 (the reverse side of the surface that forms the left side face of the ink cartridge 20). There is no particular restriction on the method for affixing the ink pack 7. For example, the ink pack 7 may be affixed to the support plate member 40 by an adhesive, double-sided adhesive tape, or the like.

The positional relationship between the ink pack 7 and the support plate member 40 will be explained. The ink pack 7 is affixed to the support plate member 40 such that, of the first end portion 41 and the oblique side portion 432 that form the obtuse angle, the axial line X of the spout 72 is substantially parallel to the first end portion 41, which extends in the longitudinal direction. The ink pack 7 is also affixed to the support plate member 40 such that the second opening 702 of the spout 72 is positioned in the vicinity of the oblique side portion 432. Furthermore, in the direction that is orthogonal to the axial line X, the axial line X is positioned closer to the first end portion 41 of the support plate member 40. In the present embodiment, the spout 72 is provided in the vicinity of the corner portion that connects the first end portion 41 and the oblique side portion 432 that form the obtuse angle. The leading end portion 724 of the spout 72, as seen from the direction that is orthogonal to the portion of the support plate member 40 with the greatest surface area (the face that is shown in FIG. 18), does not project farther to the outside of the support plate member 40 than the oblique side portion 432. That is, the leading end portion 724 is positioned toward the inner side of the support plate member 40 from the oblique side portion 432.

In the direction that is orthogonal to the axial line X, the axial line X is closer to the first end portion 711 of the ink bag 71. Accordingly, taking the axial line X as a boundary, a width W1 (the distance between the axial line and the first end portion 711 of the ink bag 71) of the ink bag 71 on the first end portion 41 side is narrower than a width W2 (the distance between the axial line X and the second end portion 712) of the ink bag 71 on the second end portion 42 side.

Figure 20:
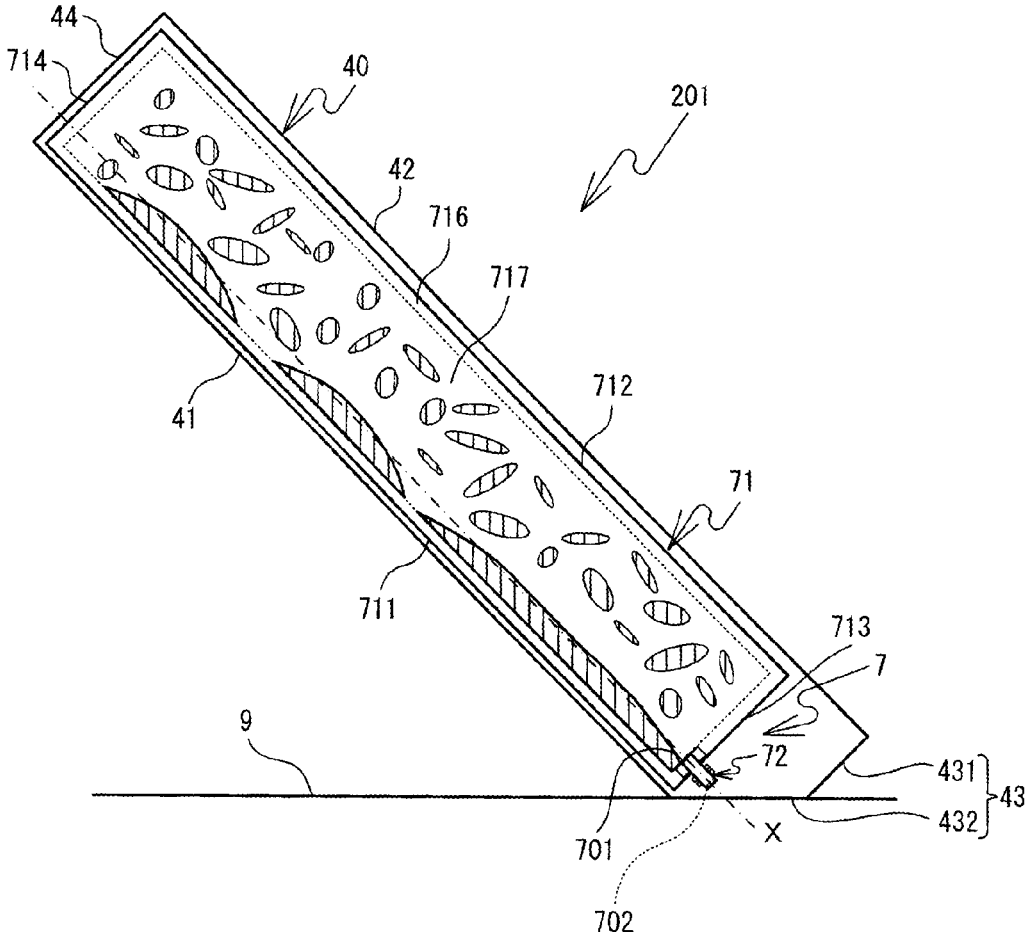
FIG. 20 is an explanatory view showing a process in which the ink is collected by tilting the ink bag unit.

Because the ink pack 7 of the present embodiment has this sort of structure, the ink that remains in the ink storage portion 717 can be collected efficiently toward the spout 72, or more specifically, toward the first opening 701. This operational effect will be explained with reference to FIG. 20. The user may separate the ink bag unit 201 from the ink cartridge 20, which is in a state in which the amount of the remaining ink has decreased and the ink has accumulated to a certain extent along the first end portion 711, as shown in FIG. 20. Then, the user may place the ink bag unit 201 on the support surface 9, which is a substantially horizontal surface, with the oblique side portion 432 on the bottom side. At this time, the user may place the ink bag unit 201 such that the oblique side portion 432 is in contact with the support surface 9. The leading end portion 724 of the spout 72 does not project farther to the outside than the oblique side portion 432. That is, the leading end portion 724 is positioned toward the inner side of the support plate member 40 from the oblique side portion 432. Therefore, when the oblique side portion 432 is in contact with the surface on which the oblique side portion 432 has been placed, the spout 72 does not come in contact with the support surface 9.

In the support plate member 40, the oblique side portion 432 and the first end portion 41 form an obtuse angle. Accordingly, the first end portion 41, which is substantially parallel to the axial line X of the spout 72, may be inclined in relation to the horizontal direction. Therefore, the second opening 702 of the spout 72 is in a state in which the second opening 702 faces obliquely downward. In the ink bag 71, the first end portion 711 may be inclined in relation to the horizontal direction. The surfaces of the two layers of the sheets that form the ink storage portion 717 may be disposed such that the surfaces of the two layers of the sheets extend substantially in the up-down direction. The user may thus hold the ink bag unit 201 stably in an inclined state by using the oblique side portion 432 of the support plate member 40. The subsequent movement of the ink within the ink storage portion 717 may be the same as in the case of the ink cartridge 1 of the first embodiment, so an explanation will be omitted.

Even in the ink bag unit 201, the axial line X of the spout 72 is positioned closer to one end portion (the first end portion 41) of the support plate member 40 in the direction that is orthogonal to the axial line X. The first end portion 41 and the oblique side portion 432 form an obtuse angle. Accordingly, when the ink bag unit 201 is inclined such that the oblique side portion 432 is made substantially horizontal, the spout 72 may be disposed in a position that is closer to the support surface 9. The ink may therefore tend to collect close to the first opening 701 of the spout 72. The axial line X is also in a position to closer to one end portion (the first end portion 711) of the ink bag 71 in the direction that is orthogonal to the axial line X. Taking the axial line X as a boundary, the width of the ink bag 71 on the first end portion 711 side is narrower than the width of the ink bag 71 on the opposite side of the axial line X. Therefore, when the ink cartridge 20 is inclined such that the oblique side portion 432 is made substantially horizontal, the ink may tend to collect close to the first opening 701 of the spout 72.

Thus, even in the ink bag unit 201, the ink that remains in the ink storage portion 717 can be efficiently collected toward the first opening 701 of the spout 72 in the same manner as in the ink cartridge 1 of the first embodiment. The ink cartridge 20 (refer to FIG. 17), in which the ink bag unit 201 is joined to the case body 202, has the same structure as the ink cartridge 1. Therefore, when the amount of the remaining ink has become small, the ink can be efficiently collected toward the first opening 701 of the spout 72 by using the inclined surface portion 332, even if the ink cartridge 20 has not been separated into the ink bag unit 201 and the case body 202. However, if the ink bag unit 201 is separated and the ink is collected using the oblique side portion 432, as described above, the flow of the ink is visible to the user. Therefore, the user can check whether the ink has collected sufficiently around the first opening 701. The weight of the ink bag unit 201 is also lighter than that of the ink cartridge 20 to the extent that the case body 202 has been removed. The burden on the user in a case where the user holds the ink bag unit 201 in the inclined state for a long time can therefore be reduced.

Figure 21:
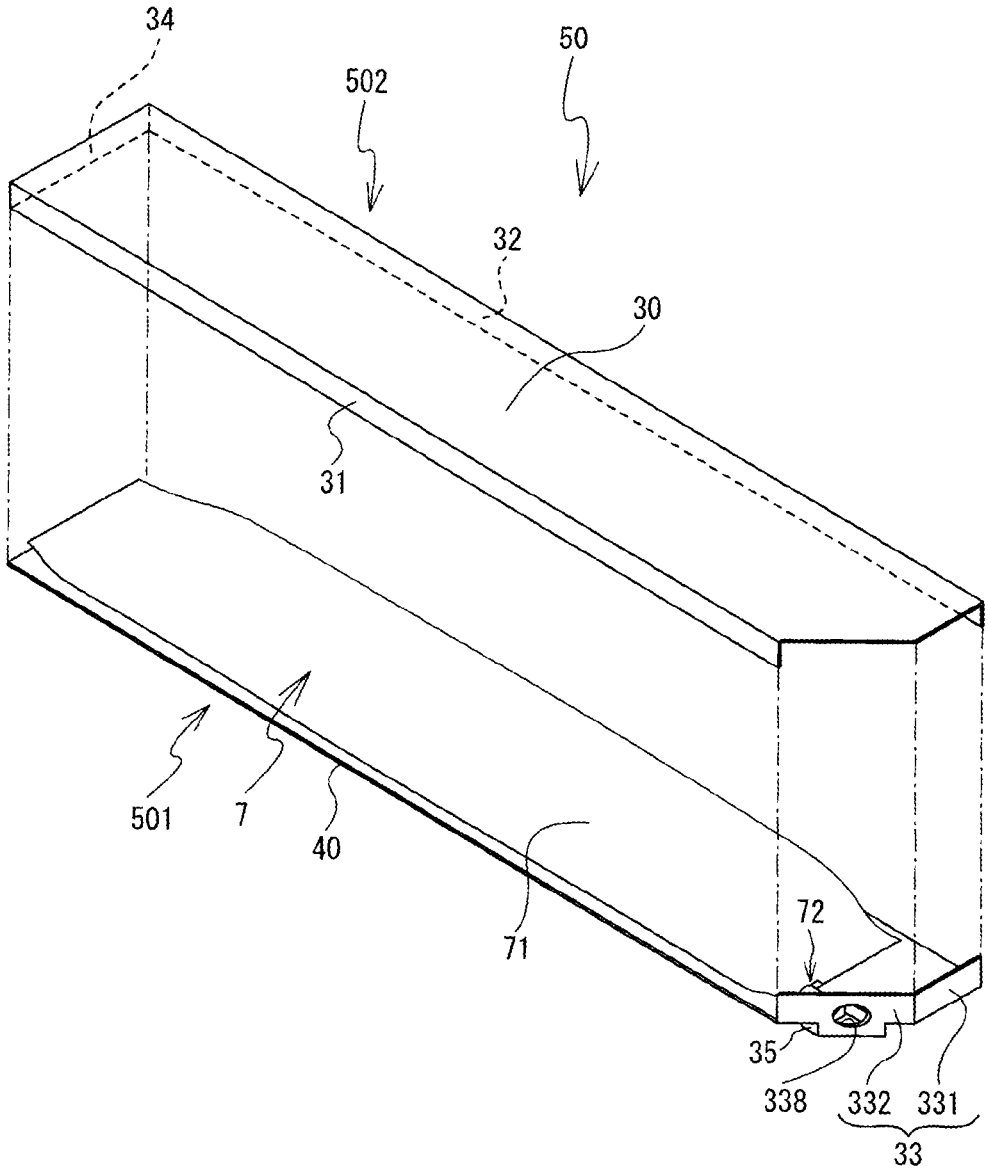
FIG. 21 is an exploded oblique view of the ink cartridge that includes an ink bag unit according to a modified example.
Figure 22:
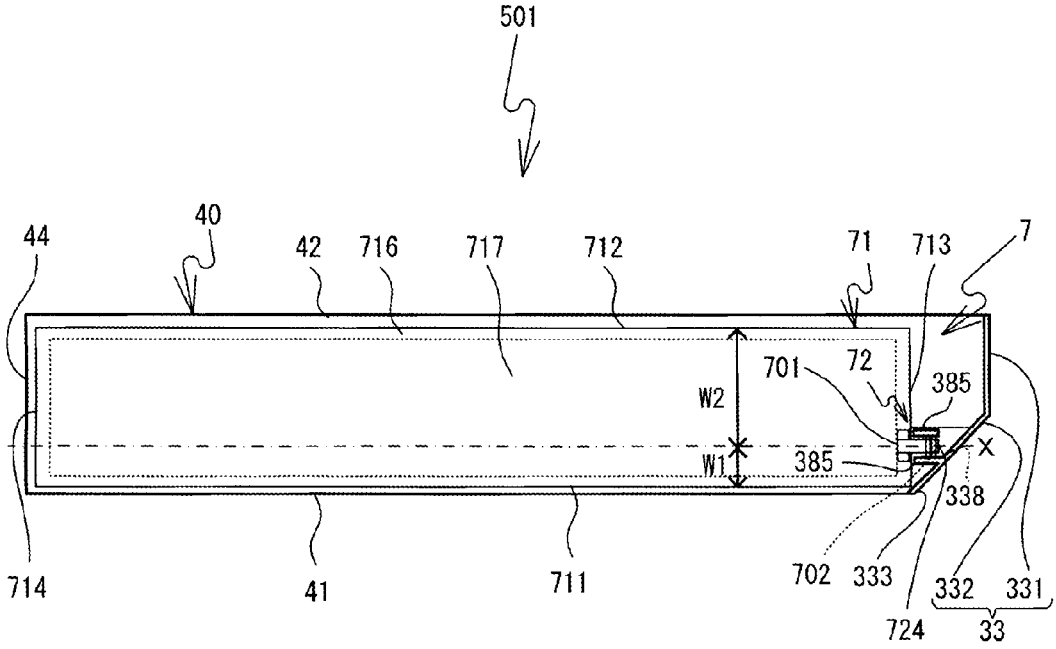
FIG. 22 is an explanatory view showing the ink bag unit as seen from the right side.

The ink bag unit 201 is an example of the ink pack 7 being affixed to the support plate member 40, which is a single thin plate. However, in the present embodiment, at least one of the peripheral walls 31 to 34 that are provided in the case body 202 may also be formed such that the at least one of the peripheral walls 31 to 34 are continuous with the support plate member 40. This sort of modified example will be explained with reference to FIGS. 21 and 22. An ink bag unit 501 of the modified example, which is shown in FIGS. 21 and 22, is equivalent to a unit in which the ink pack 7 is affixed to the lid portion 4, to which the rear wall 33 (the rear surface portion 331 and the inclined surface portion 332) is connected, as in the ink cartridge 12 of the modified example of the first embodiment, which is shown in FIG. 13.

More specifically, the inclined surface portion 332 is connected to the oblique side portion 432 of the support plate member 40 and extends to the right face side of the support plate member 40 (toward the inner side of the an ink cartridge 50). The rear surface portion 331 is connected the vertical portion 431 and the inclined surface portion 332. The projecting portion 35 is provided in the support plate member 40. The pair of the fixing portions 385 are provided on the first end portion 41 side and the second end portion 42 side of the spout 72. The pair of the fixing portions 385 are pieces that project from the inner surface of the projecting portion 35 toward the inner side of the case 2. Of the fixing portions 385, the fixing portion 385 on the first end portion 41 side is formed such that the fixing portion 385 is also continuous with the inclined surface portion 332. The penetration portion 338 is provided in the inclined surface portion 332 such that the penetration portion 338 is opposite the second opening 702 of the spout 72.

The positional relationship of the support plate member 40 and the ink pack 7 in the ink bag unit 501 is basically the same as in the ink bag unit 201 that is shown in FIG. 19. In other words, the ink pack 7 is affixed to the support plate member 40 such that, of the first end portion 41 and the oblique side portion 432 that form the obtuse angle, the axial line X of the spout 72 is substantially parallel to the first end portion 41, which extends in the longitudinal direction. The ink pack 7 is also affixed to the support plate member 40 such that the second opening 702 of the spout 72 is positioned in the vicinity of the oblique side portion 432. Furthermore, in the direction that is orthogonal to the axial line X, the axial line X is positioned closer to the first end portion 41 of the support plate member 40. In the present embodiment, the leading end portion 724 on the second opening 702 side of the spout 72, as seen from the direction that is orthogonal to the portion of the support plate member 40 with the greatest surface area (the face that is shown in FIG. 19), does not project to the outside of the support plate member 40 from the outer surface 333 of the inclined surface portion 332 that is connected to the oblique side portion 432. That is, the leading end portion 724 is positioned toward the inner side of the support plate member 40 from the oblique side portion 432.

The structure of the ink bag unit 501 that is described above makes it possible, in a case where the amount of the remaining ink is small, to place the inclined surface portion 332 that is connected to the oblique side portion 432 on a substantially horizontal surface and to hold the ink bag unit 501 more stably in an inclined state. Therefore, the ink that remains can be collected more efficiently toward the spout 72. In other words, in addition to the effect of the above-described ink bag unit 201, the ink bag unit 501 of the present modified example is able to demonstrate the same sort of effect as does the ink cartridge 12 of the modified example of the first embodiment, which is shown in FIG. 13.

Figure 23:
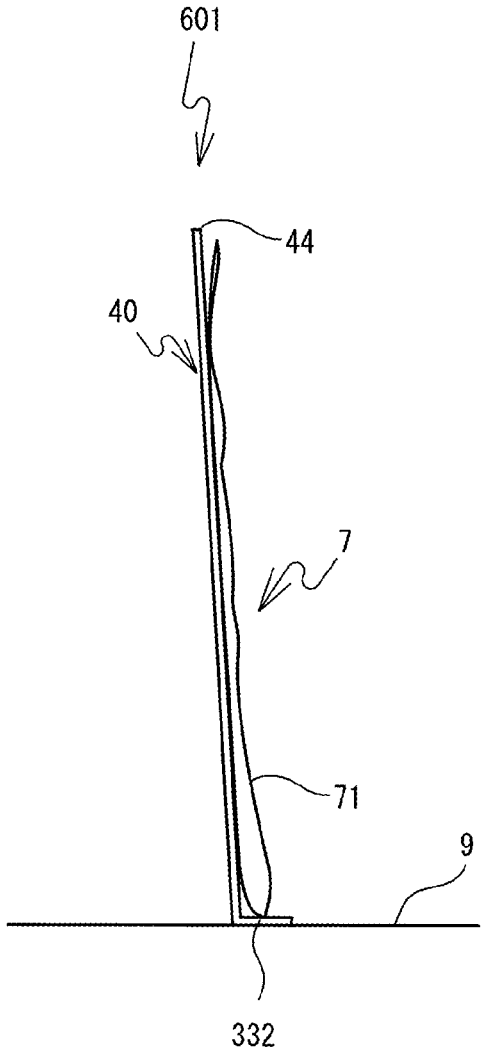
FIG. 23 is an explanatory view of the ink bag unit according to another modified example, as seen from the front, in a state in which the ink bag unit is tilted by using an inclined surface portion.

The rear surface portion 331 may be omitted from the modified example that is shown in FIGS. 21 and 22. That is, it is acceptable for only the inclined surface portion 332 to be added to the support plate member 40. Even in this modified example, the same sort of effect as that of the ink bag unit 501 can be demonstrated by the inclined surface portion 332. Furthermore, in an ink bag unit 601 of the modified example in which only the inclined surface portion 332 is added to the support plate member 40, as shown in FIG. 23, the inclined surface portion 332 and the right face of the support plate member 40 may form an obtuse angle. In this case, when the inclined surface portion 332 is placed on a substantially horizontal surface, the right face of the support plate member 40 is in an inclined state in which the right face of the support plate member 40 extends upward at a slant. Accordingly, even if the ink bag 71 is affixed to the right face of the support plate member 40, the burden on the portion where the ink bag 71 is affixed may be reduced. Therefore, the possibility that the portion where the ink bag 71 is affixed will be damaged may be reduced. In FIG. 23, the upper face of the inclined surface portion 332 and the entire right face of the support plate member 40 form an obtuse angle. However, it is acceptable as long as the inclined surface portion 332 to form an obtuse angle with at least a portion of the right face of the support plate member 40.

The inclined surface portion 332 in FIG. 2 may be formed from a hard resin as a part of the case 2. The inclined surface portion 332 may be a flexible film (for example, adhesive tape) that is affixed to an end portion of the case 2. A replaceable member may be used as the inclined surface portion 332.

When the effect of collecting the ink of the ink cartridge 1 toward the spout 72 is explained above (refer to FIGS. 7 to 9), an example is given in which the user holds the ink cartridge 1 by hand while causing the inclined surface portion 332 to come into contact with the substantially horizontal support surface 9. However, the ink cartridge 1 may be caused to stand such that the lower end of the front wall 34 of the ink cartridge 1 is brought into contact with a substantially vertical surface (for example, a wall) indicated by a dashed line Y in FIG. 7, while the inclined surface portion 332 is brought into contact with the substantially horizontal support surface 9. In this case, the user need not hold the ink cartridge 1 by hand.

In addition to the modified example that is described above, a modified example may be made in which only the inclined surface portion 332 and the bottom wall 31 are added to the support plate member 40. All of the peripheral walls 31 to 34 may be added to the support plate member 40. In other words. It is possible to add some or all of the peripheral walls 31 to 34 to the support plate member 40, as desired. The support plate member 40 to which all of the peripheral walls 31 to 34 have been added is equivalent to the state in which the ink pack 7 is affixed to the body portion 3 of the ink cartridge 1 according to the first embodiment, which is shown in FIG. 3.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An ink cartridge comprising:

an ink bag comprising two layers of flexible sheets disposed to face each other to form an ink storage portion configured to store ink inside;

a spout that is provided on the ink bag and that comprises a hollow portion that leads from a first opening to a second opening, wherein the first opening is communicatively connected with the ink storage portion, and the second opening is provided in a leading end portion of the spout and is open to an outside of the ink bag; and a case configured to house the ink bag, the case comprising:

an inclined surface portion; and a penetration portion, wherein the inclined surface portion is a surface portion that is disposed obliquely in relation to an axial direction of the spout, the penetration portion is provided in the inclined surface portion and is opposite the second opening, each of the two layers of flexible sheets extends substantially parallel to a virtual plane that includes an axial line of the spout and that forms a right angle with the inclined surface portion, the spout is positioned further inside of the case than an outer face of the inclined surface portion, and the axial line of the spout is positioned closer to one end portion of the case in a first direction than another end portion of the case, the first direction is orthogonal to the axial direction and to a second direction, and the second direction is orthogonal to the axial direction and to a longitudinal direction of the inclined surface portion.

2. The ink cartridge according to claim 1, wherein the axial direction of the spout is a longitudinal direction of the case, and the axial line of the spout and the inclined surface portion in a direction toward the one end portion of the case form an acute angle.

3. The ink cartridge according to claim 2, wherein the axial line of the spout is positioned closer to one end portion of the ink bag in the first direction than another end portion of the ink bag, and a width of the ink bag on the one end portion side of the case from the axial line is narrower than a width of the ink bag on the other end portion side of the case from the axial line.

4. The ink cartridge according to claim 1, wherein the case further comprises at least one surface portion that is continuous with the inclined surface portion.

5. The ink cartridge according to claim 1, wherein the case further comprises a fixing portion that is continuous with the inclined surface portion and that is configured to affix the spout to the inclined surface portion.

6. The ink cartridge according to claim 1, wherein the case further comprises a side face portion that is continuous with the inclined surface portion, wherein the side face portion comprises a projecting portion, the axial direction of the spout is a longitudinal direction of the side face portion, and the projection portion is a member that projects toward an outside of the case, the penetration portion is provided in a portion of the inclined surface portion that is continuous with the projecting portion, and the spout is disposed inside of the projecting portion.

7. The ink cartridge according to claim 1, wherein the case further comprises a pair of side face portions that are mutually opposed, wherein each of the pair of the side face portions is continuous with the inclined surface portion, the axial direction of the spout is a longitudinal direction of each of the pair of the side face portions, and a pair of recessed portions are formed in mutually opposed positions of the pair of the side face portions.

8. The ink cartridge according to claim 1, wherein the ink is a pigment ink that contains a pigment.

9. The ink cartridge according to claim 8, wherein the pigment ink contains titanium oxide.

10. The ink cartridge according to claim 1, wherein the ink contains an emulsion.

11. The ink cartridge according to claim 10, wherein the ink contains a pigment.

12. An ink bag unit comprising:

an ink bag comprising two layers of flexible sheets disposed to face each other to form an ink storage portion configured to store ink inside;

a spout that is provided on the ink bag and that comprises a hollow portion that leads from a first opening to a second opening, wherein the first opening is communicatively connected with the ink storage portion, and the second opening is provided in a leading end portion of the spout and is open to an outside of the ink bag; and a plate member comprising:

a first surface, a second surface, and two edges, wherein the second surface is a reverse side of the first surface, the two edges form an obtuse angle, an outer surface of one of the two layers of flexible sheets of the ink bag is affixed to the first surface, an axial line of the spout is substantially parallel to a first edge that is one of the two edges of the plate member, the leading end portion of the spout is, in the axial direction, located on a side of a second edge with respect to a corner portion forming the obtuse angle, wherein the second edge is the other of the two edges of the plate member, and the leading end portion of the spout is, in the axial direction, located on a side of the corner portion with respect to the second edge.

13. The ink bag unit according to claim 12, wherein the axial line of the spout is positioned closer to the first edge of the plate member in a direction that is orthogonal to the axial line than the third edge.

14. The ink bag unit according to claim 12, further comprising:

a surface portion that is continuous with the second edge of the plate member and that extends to a side where the ink bag is affixed; and a penetration portion that is provided in the surface portion and that is opposite the second opening of the ink bag.

15. The ink bag unit according to claim 14, wherein the surface portion and at least a portion of the first surface of the plate member form an obtuse angle.

16. An ink cartridge, comprising:

an ink bag comprising two layers of flexible sheets disposed to face each other to form an ink storage portion configured to store ink inside;

a spout comprising a hollow portion that leads from a first opening to a second opening, wherein the first opening is communicatively connected with the ink storage portion, and the second opening is provided in a leading end portion of the spout and is open to an outside of the ink bag; and a case comprising:

a first surface portion;

a second surface portion; and a third surface portion, wherein the first surface portion is opposite one of the two layers of the sheets, extends in an axial line direction that is a direction of an axial line of the spout, and has a first edge located on a side of the second opening in the axial line direction, the first edge extends from a position that is farther from the first opening than is the second opening to a position that is closer to the first opening than is the second opening in the axial line direction, wherein the second surface portion is opposite the other of the two layers of the sheets, is on an opposite side of the ink bag from the first surface portion, extends in the axial line direction, and has a second edge located on a side the second opening in the axial line direction, the second edge extends from a position that is farther from the first opening than is the second opening to a position that is closer to the first opening than is the second opening in the axial line direction, wherein the third surface portion has a surface area that is smaller than each surface area of the first surface portion and the second surface portion, obliquely intersects the axial line direction along the first edge and the second edge, and is farther in the axial line direction from the first opening than is the second opening, the leading end portion of the spout does not project toward an outside from the third surface portion, and wherein the axial line of the spout is positioned closer to one end portion of the case in a first direction than another end portion of the case, the first direction is orthogonal to the axial direction and to a second direction, and the second direction is orthogonal to the axial direction and to a direction in which the third surface portion extends along the first edge and the second edge.

17. The ink cartridge according to claim 1, wherein the spout comprises a flange provided along an outer periphery of the spout, and the flange is positioned further inside of the case than the outer face of the inclined surface portion.

18. The ink bag unit according to claim 12, wherein the spout comprises a flange provided along an outer periphery of the spout, and the flange does not project toward an outside of the plate member from the second side.

19. The ink cartridge according to claim 16, wherein the spout comprises a flange provided along an outer periphery of the spout, and the flange does not project toward the outside from the third surface portion.

* * * * *